US012674248B2

(12) United States Patent
Nagasawa et al.

(10) Patent No.: US 12,674,248 B2
(45) Date of Patent: Jul. 7, 2026

(54) PLATING APPARATUS, CONTROL METHOD FOR PLATING APPARATUS AND NONVOLATILE STORAGE MEDIUM STORING PROGRAM

(71) Applicant: EBARA CORPORATION, Tokyo (JP)

(72) Inventors: Yosuke Nagasawa, Tokyo (JP); Tensei Sato, Tokyo (JP); Hideki Wakabayashi, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 650 days.

(21) Appl. No.: 18/083,995

(22) Filed: Dec. 19, 2022

(65) Prior Publication Data

US 2023/0203702 A1 Jun. 29, 2023

(30) Foreign Application Priority Data

Dec. 24, 2021 (JP) ..... 2021-210708

(51) Int. Cl.
*C25D 21/12* (2006.01)
*C25D 17/00* (2006.01)
*C25D 21/10* (2006.01)

(52) U.S. Cl.
CPC ..... *C25D 21/12* (2013.01); *C25D 17/001* (2013.01); *C25D 21/10* (2013.01)

(58) Field of Classification Search
CPC ..... C25D 7/12–123; C25D 17/001; H01L 21/2885; H01L 21/76873; H01L 2224/11462
See application file for complete search history.

(56) References Cited

U.S. PATENT DOCUMENTS

2019/0237350 A1 8/2019 Mitsuya

FOREIGN PATENT DOCUMENTS

JP 2019-133998 A 8/2019

*Primary Examiner* — Hosung Chung
(74) *Attorney, Agent, or Firm* — BakerHostetler

(57) ABSTRACT

The present disclosure provides a plating apparatus that can determine an acceleration at the time of an inappropriate deceleration of a transfer device that may cause contact between a substrate holder and a processing tank, a control method for a plating apparatus, and a storage medium storing a program. The plating apparatus according to the present disclosure includes a transfer device including an imaging device, the processing tank having an opening, a reference mark, and a control device, the control device is configured to be able to execute a test at a test acceleration, and the test includes: controlling, by the control device, the imaging device to capture a reference image when the transfer device is located at a determination position directly above the processing tank; moving the transfer device from a reference position to the determination position; controlling the imaging device to capture a comparison video when and after the transfer device stops; and determining, based on the reference image and the comparison video, whether the lower end portion of the substrate holder protrudes outside a region where the opening is extended in a vertical direction, to determine that the test acceleration has an inappropriate value when the lower end portion protrudes outside the region.

12 Claims, 15 Drawing Sheets

| No. | CONDITION CONTENT |
|---|---|
| CONDITION (1) | THERE IS DETERMINATION POSITION AT WHICH TEST IS NOT PERFORMED |
| CONDITION (2) | VARIATION COMPARISON VALUE ≦THRESHOLD |
| CONDITION (3) | THERE IS NO REFERENCE POSITION AT WHICH TEST IS NOT PERFORMED |

PLATING APPARATUS, CONTROL METHOD FOR PLATING APPARATUS AND NONVOLATILE STORAGE MEDIUM STORING PROGRAM

CROSS-REFERENCE TO RELATED APPLICATION

This application is based upon and claims benefit of priority from Japanese Patent Application No. 2021-210708 filed on Dec. 24, 2021, the entire contents of which are incorporated herein by reference.

TECHNICAL FIELD

The present invention relates to a plating apparatus, a control method for a plating apparatus and a nonvolatile storage medium storing a program.

BACKGROUND ART

A plating apparatus is used to form a thin metal film on the surface of a substrate. An example of this plating apparatus is disclosed in Patent Literature 1. The plating apparatus disclosed in Patent Literature 1 includes a plurality of processing tanks and a transfer machine as illustrated in FIG. 1 of the literature. The transfer machine transfers a substrate holder in a vertical direction and a transfer direction perpendicular to the vertical direction. Specifically, the transfer machine performs an operation of pulling up the substrate holder from one processing tank, an operation of moving the substrate holder from an upper part of the one processing tank to an upper part of another processing tank, and an operation of housing the substrate holder in the other processing tank. In this way, this transfer machine transfers the substrate holder from one processing tank to another processing tank.

Further, the plating apparatus of Patent Literature 1 includes a storage medium storing a transfer scheduler that is scheduling software for calculating a transfer schedule as described in paragraph [0021] of the literature. Then, the transfer scheduler executes standard transfer scheduling for all substrates. By this standard transfer scheduling, a standard transfer schedule for performing transfer control with a maximum throughput is prepared from an operation time of each transfer machine that is given in advance (time required for transferring the substrate with the transfer machine), processing conditions of a target substrate for which a processing instruction is received (process recipe), and a set value of the number of substrates to be processed or the like.

CITATION LIST

Patent Literature

PTL 1: Japanese Patent Laid-Open No. 2019-133998

SUMMARY OF INVENTION

Technical Problem

In a plating apparatus of PTL 1, as described above, a transfer machine performs an operation of moving a substrate holder from an upper part of one processing tank to an upper part of another processing tank when transferring the substrate holder. Specifically, the transfer machine gripping the substrate holder moves in a transfer direction and stops in the upper part of the other processing tank. At this time, the substrate holder gripped by the transfer machine may vibrate in the transfer direction due to inertial force and swing like a pendulum. The swing of the substrate holder is related to an acceleration at the time of a deceleration of the transfer machine, and the larger a magnitude of acceleration is, the larger the swing of the substrate holder becomes. Then, when the transfer machine tries to house the noticeably vibrating substrate holder into the processing tank, the substrate holder cannot pass through an opening of the processing tank, and the substrate holder might come in contact with the processing tank (an edge of the opening).

Furthermore, the acceleration at the time of the deceleration of the transfer machine may be one of set values for preparing such a transfer schedule as described above. When the transfer schedule is prepared from the set value of the acceleration at the time of an inappropriate deceleration of the transfer machine and a normal operation is performed according to this transfer schedule, there is concern that the substrate holder comes in contact with the processing tank. For this reason, it is important to determine whether or not the acceleration at the time of the deceleration of the transfer machine has an inappropriate value that may cause the contact between the substrate holder and the processing tank.

Therefore, one of objects of the present disclosure is to provide a plating apparatus, a control method for a plating apparatus, and a storage medium storing a program, that can determine an acceleration at the time of an inappropriate deceleration of a transfer device (transfer machine) that may cause contact between a substrate holder and a processing tank.

Solution to Problem

A plating apparatus according to one embodiment is a plating apparatus including a transfer device for transferring a substrate holder in a vertical direction and a transfer direction perpendicular to the vertical direction, the transfer device including an imaging device, a processing tank having an opening for the substrate holder to be put inside, a reference mark, and a control device that controls the transfer device and the imaging device, the plating apparatus having a first mode in which the control device is configured to execute a test at a test acceleration, and the test includes: controlling, by the control device, the imaging device to capture a reference image so that the opening and the reference mark are reflected, when the transfer device is located at a determination position directly above the processing tank; moving, by the control device, the transfer device from a reference position to the determination position so that the transfer device gripping the substrate holder decelerates at the test acceleration and stops at the determination position; controlling, by the control device, the imaging device to capture a comparison video so that the reference mark and a lower end portion of the substrate holder are reflected, when and after the transfer device stops; and determining, by the control device, whether the lower end portion of the substrate holder protrudes outside a region where the opening is extended in the vertical direction when and after the transfer device stops, based on the reference image and the comparison video, to determine that the test acceleration has an inappropriate value when the lower end portion protrudes outside the region.

A control method for a plating apparatus according to one embodiment is a control method for a plating apparatus including: a step of controlling an imaging device to capture a reference image so that an opening of a processing tank and a reference mark are reflected when a transfer device is located at a determination position directly above the processing tank; a step of moving the transfer device from a reference position to the determination position so that the transfer device gripping a substrate holder decelerates at a test acceleration and stops at the determination position; a step of controlling the imaging device to capture a comparison video so that the reference mark and a lower end portion of the substrate holder are reflected when and after the transfer device stops; and a step of determining, based on the reference image and the comparison video, whether the lower end portion of the substrate holder protrudes outside a region where the opening is extended in a vertical direction when and after the transfer device stops, to determine that the test acceleration has an inappropriate value when the lower end portion protrudes outside the region.

A nonvolatile storage medium according to one embodiment is a nonvolatile storage medium storing a program for allowing a computer to execute a method of controlling a plating apparatus, the program being stored for allowing the computer to execute: controlling an imaging device to capture a reference image so that an opening of a processing tank and a reference mark are reflected when a transfer device is located at a determination position directly above the processing tank; moving the transfer device from a reference position to the determination position so that the transfer device gripping a substrate holder decelerates at a test acceleration and stops at the determination position; controlling the imaging device to capture a comparison video so that the reference mark and a lower end portion of the substrate holder are reflected when and after the transfer device stops; and determining, based on the reference image and the comparison video, whether the lower end portion of the substrate holder protrudes outside a region where the opening is extended in a vertical direction when and after the transfer device stops, to determine that the test acceleration has an inappropriate value when the lower end portion protrudes outside the region.

DESCRIPTION OF EMBODIMENTS

Figure 1:
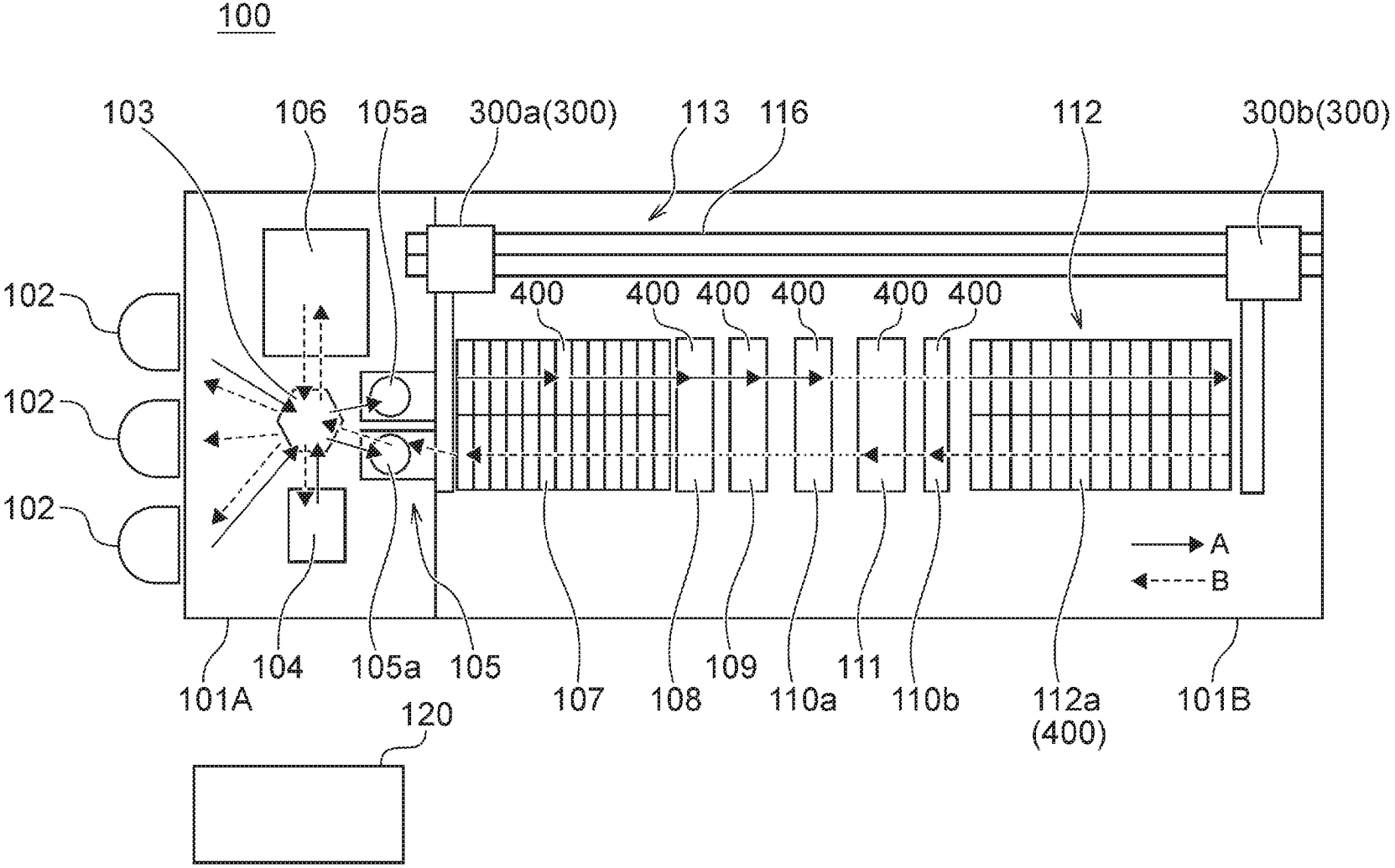
FIG. 1 is a plan view of a plating apparatus according to an embodiment of the present disclosure.

Hereinafter, embodiments of the present invention will be described with reference to the drawings. In the drawings described below, the same or corresponding components are denoted with the same reference sign and will not be described in duplicate.

FIG. 1 is a plan view of a plating apparatus 100 according to an embodiment of the present disclosure. Referring to FIG. 1, the plating apparatus 100 includes a load/unload area 101A, and a processing area 101B. The load/unload area 101A is an area for loading a substrate W (see FIG. 3) in a substrate holder 200 (see FIG. 3) or for unloading the substrate W from the substrate holder 200. The processing area 101B is an area for processing the substrate W. The plating apparatus 100 as an example is a wet vertical electroplating apparatus. Note that the plating apparatus 100 may perform processing on a substrate having a circular, square or any other shape. Also, examples of the substrate W processed with the plating apparatus 100 include a semiconductor wafer, a glass substrate, a liquid crystal substrate, a printed circuit board and another object to be processed. Further, a size of the substrate W is not particularly limited and may be 300 mm□300 mm. In the present application, the substrate holder 200 means a holder for holding the substrate W.

As illustrated in FIG. 1, the plating apparatus 100 includes, in the load/unload area 101A, a plurality of cassette tables 102, an aligner 104, a load/unload station 105, a spin rinse dryer 106, and a transfer robot 103. First, these components of the plating apparatus 100 will be described. Each of the cassette tables 102 has a function of mounting a cassette housing the substrate W. The aligner 104 has a function of adjusting a position of an orientation flat, a notch or the like of the substrate W in a predetermined direction. The load/unload station 105 includes one or more substrate attaching/detaching devices 105*a* configured to attach and detach the substrate W to and from the substrate holder 200. The spin rinse dryer 106 has a function of cleaning, rotating, at a high speed, and drying the plated substrate W. The transfer robot 103 has a function of transferring the substrate W between the cassette tables 102, the aligner 104, the load/unload station 105 and the spin rinse dryer 106.

The plating apparatus 100 includes, in the processing area 101B, a stocker 107, a prewet module 108, a presoak module 109, a first rinse module 110*a*, a blow module 111, a second rinse module 110*b*, and a plating module 112. The stocker 107 has a function of housing the substrate holder 200. In the prewet module 108, the substrate W is immersed in pure water. In the presoak module 109, an oxide film on the surface of a conductive layer such as a seed layer formed on the surface of the substrate W is etched and removed. In the first rinse module 110*a*, the presoaked substrate W is cleaned together with the substrate holder 200 with a cleaning solution (pure water or the like). In the blow module 111, liquid draining of the cleaned substrate W is performed. In the second rinse module 110*b*, the plated substrate W is cleaned together with the substrate holder 200 with the cleaning solution. The plating module 112 includes a plurality of plating tanks 112*a* provided with an overflow tank. Each plating tank 112*a* houses one substrate W inside, and immerses the substrate W in a plating solution held inside to perform plating such as copper plating on the surface of the substrate W. Here, a type of plating solution is not particularly limited, and various plating solutions are used depending on a use application. When one substrate W is subjected to a plurality of different plating processes, the plating module 112 includes the plurality of plating tanks 112*a* containing different types of plating solutions. Further, the stocker 107, the prewet module 108, the presoak module 109, the first rinse module 110*a*, the blow module 111, the second rinse module 110*b* and the plating module 112 include a processing tank 400 for housing the substrate holder 200 in order to perform the above-described processing on the substrate W or the substrate holder 200. In the present disclosure, a tank that can house the substrate holder is referred to as a processing tank. The plating tank 112*a* is an example of the processing tank 400.

Referring to FIG. 1 again, the plating apparatus 100 further includes a substrate holder transfer device 113 adopting, for example, a linear motor system for transferring the substrate holder 200. The substrate holder transfer device 113 includes a rail 116, a first transfer device 300*a*, and a second transfer device 300*b*. Note that the first transfer device 300*a* and the second transfer device 300*b* can be simply referred to as a transfer device 300. The first transfer device 300*a* and the second transfer device 300*b* run on the rail 116. The first transfer device 300*a* and the second transfer device 300*b* have a function of transferring the substrate holder 200 in a vertical direction and a transfer direction perpendicular to the vertical direction. The transfer direction matches an extending direction of the rail 116. The first transfer device 300*a* has a function of transferring the substrate holder 200 between the load/unload station 105, the stocker 107, the prewet module 108, the presoak module 109, the first rinse module 110*a*, and the blow module 111. On the other hand, the second transfer device 300*b* has a function of transferring the substrate holder 200 between the first rinse module 110*a*, the blow module 111, the second rinse module 110*b* and the plating module 112. The plating apparatus 100 need not include the second transfer device 300*b* and may only include the first transfer device 300*a*, so that the first transfer device 300*a* may transfer the substrate holder 200 between the respective parts.

The plating apparatus 100 also includes a control device 120 for controlling various types of operating equipment. A detailed configuration of the control device 120 will be described later.

Next, an example of an operation of the plating apparatus 100 will be described. In the plating apparatus 100, the transfer robot 103 takes out the unprocessed substrate W from the cassette placed on the cassette table 102 and places the substrate on the aligner 104, and the aligner 104 performs positioning of the substrate W relative to the orientation flat or notch. Next, the transfer robot 103 transports the substrate W to the load/unload station 105, where the substrate W is attached to the substrate holder 200 taken out from the stocker 107. Here, the substrate W is attached to the substrate holder 200 in each of two load/unload stations 105, and two substrate holders 200 are transferred as a pair. The first transfer device 300*a* transports the substrate W attached to the substrate holder 200 to the prewet module 108. The substrate is then prewashed with water, transported to the presoak module 109, preprocessed, further transported to the first rinse module 110*a*, and washed with water.

The substrate W washed with water in the first rinse module 110*a* is transported to one of the plating tanks 112*a* of the plating module 112 by the second transfer device 300*b* and is immersed in the plating solution. Here, the substrate W is plated to form a metal film on the substrate. When a plurality of types of plating processes are performed, the substrate W is successively transferred to the plurality of plating tanks 112*a* and plated. The second transfer device 300*b* transports the plated substrate W to the second rinse module 110*b*, where the substrate is washed with water, and the device then transports the substrate to the blow module 111, where the substrate is roughly dried. Thereafter, the first transfer device 300*a* transports the substrate to the load/unload station 105, where the substrate W is removed from the substrate holder 200. The transfer robot 103 transports the substrate W removed from the substrate holder 200 to the spin rinse dryer 106, where the substrate is washed, dried and then housed in the cassette of the cassette table 102. The above-described configuration of the plating apparatus 100 is an example, and another configuration may be adopted.

Figure 2:
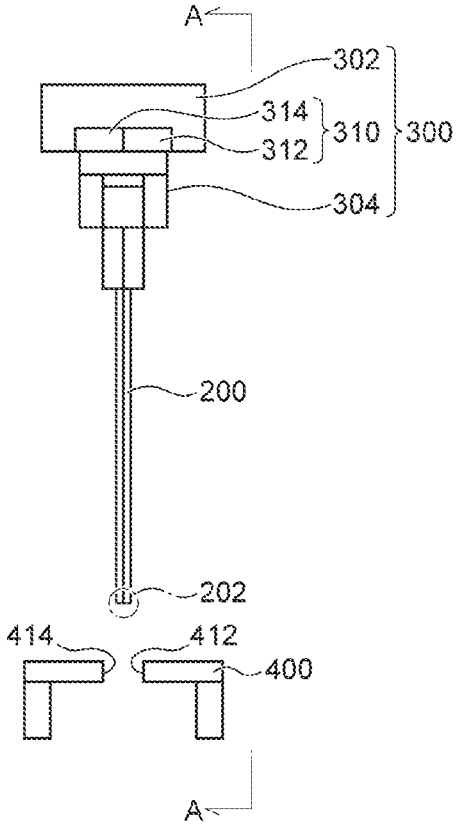
FIG. 2 is a side view of a transfer device and a processing tank illustrated in FIG. 1.
Figure 3:
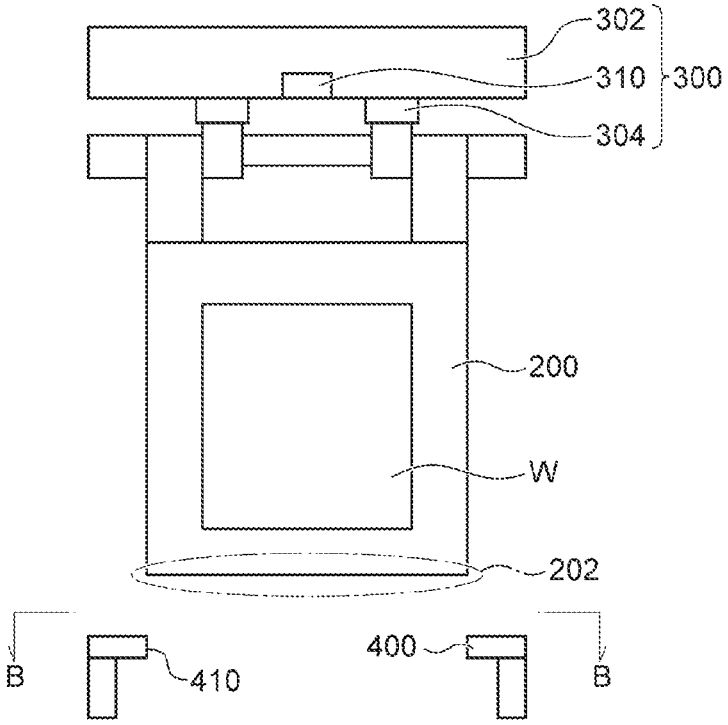
FIG. 3 is an A-A arrow view of FIG. 2.
Figure 4:
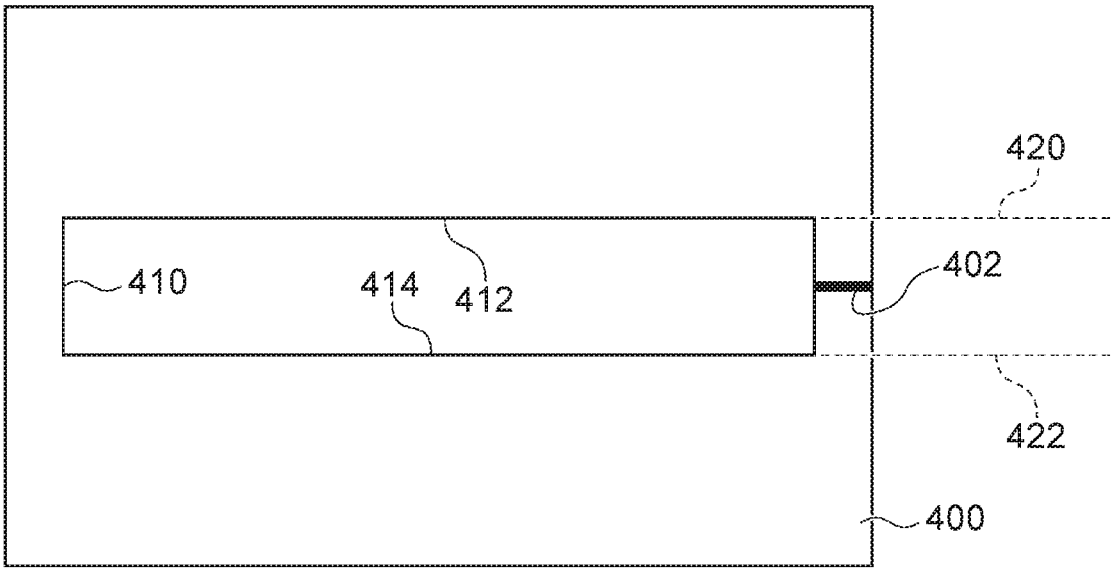
FIG. 4 is a B-B arrow view of FIG. 3.

Next, with reference to FIGS. 2 to 4, more detailed configurations of the transfer device 300 and the processing tank 400 will be described. FIG. 2 is a side view of the transfer device 300 and the processing tank 400. FIG. 3 is an A-A arrow view of FIG. 2, and FIG. 4 is a B-B arrow view of FIG. 3. Referring to FIGS. 2 and 3, the transfer device 300 includes a main body 302, a hand 304, and an imaging device 310. Referring to FIG. 4, the processing tank 400 has an opening 410 for the substrate holder 200 to be put inside, and the tank is provided with a reference mark 402. The opening 410 as an example is rectangular, and the opening 410 is formed to open in the vertical direction. The opening 410 has a first end portion 412 and a second end portion 414. The first end portion 412 extends on a first straight line 420 orthogonal to the transfer direction and the vertical direction, and the second end portion 414 extends on a second straight line 422 parallel to the first straight line 420. The reference mark 402 as an example is a linear mark extending parallel to the first straight line 420 and the second straight line 422, and the mark is located between the first straight line 420 and the second straight line 422. More specifically, the reference mark 402 is located in a middle between the first straight line 420 and the second straight line 422. The imaging device 310 also includes a first camera 312 and a second camera 314 (see FIG. 2). The first camera 312 is attached to the main body 302 so as to image in a downward direction. Furthermore, the first camera 312 is configured to image a lower end portion 202 of the substrate holder 200, the first end portion 412 and the reference mark 402, when the transfer device 300 is located directly above the processing tank 400. On the other hand, the second camera 314 is attached to the main body 302 so as to image in the downward direction. Furthermore, the second camera 314 is configured to image the lower end portion 202 of the substrate holder 200, the second end portion 414 and the reference mark 402, when the transfer device 300 is located directly above the processing tank 400. The hand 304 is attached to a lower part of the main body 302 and is configured to grip the substrate holder 200. In another embodiment according to the present disclosure, the reference mark 402 may be any portion of the plating apparatus 100 that can be identified as a mark whose positional relation with the opening 410 does not change. The reference mark 402 may be, as an example, an end portion of the opening 410, a bolt, a deliberately provided protrusion or dent, or the like.

Figure 5:
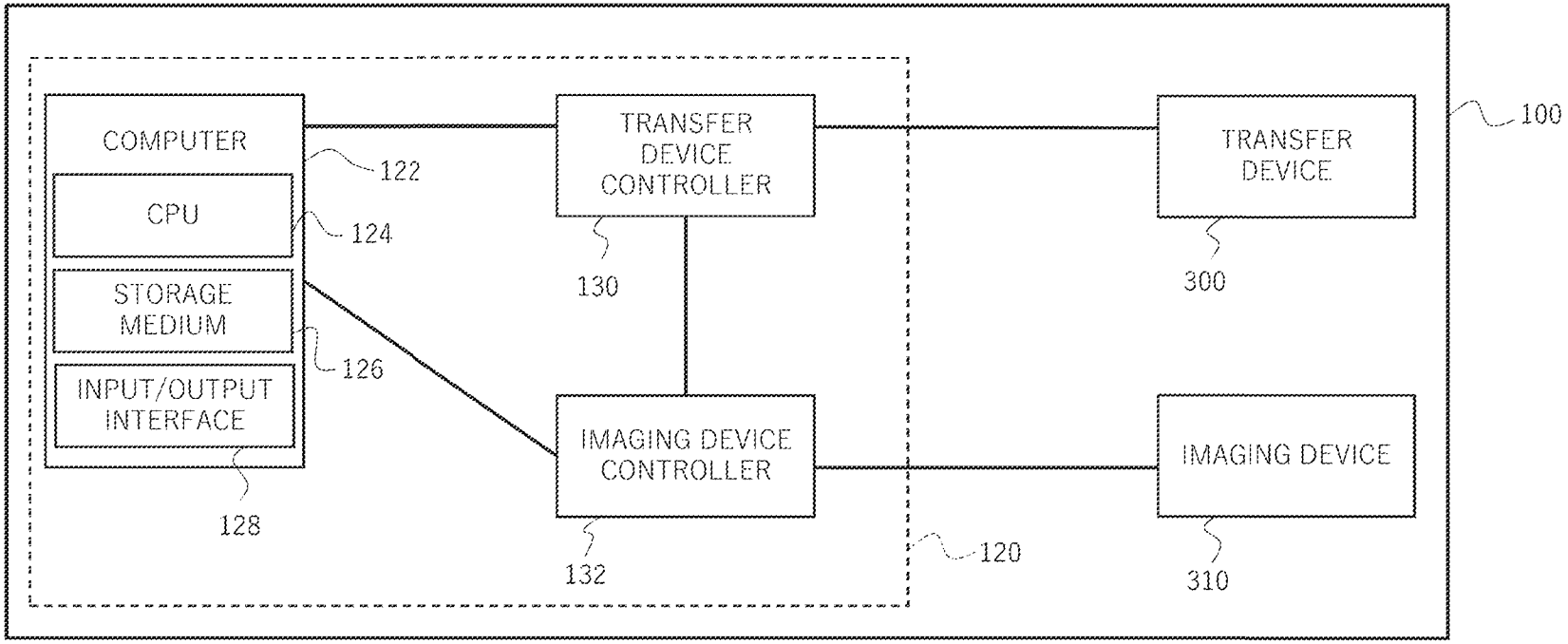
FIG. 5 is a system configuration diagram of the plating apparatus illustrated in FIG. 1.

Next, with reference to FIG. 5, a system configuration of the plating apparatus 100 will be described. FIG. 5 is a system configuration diagram of the plating apparatus 100. Referring to FIG. 5, the control device 120 as an example includes a computer 122, a transfer device controller 130, and an imaging device controller 132. As illustrated in FIG. 5, the computer 122, the transfer device controller 130 and the imaging device controller 132 are connected to one another via a wired or wireless network, a cable, or the like. The transfer device controller 130 is configured by, for example, a sequencer or the like, and is connected to the transfer device 300 via a predetermined interface. The transfer device controller 130 has a function of controlling the transfer device 300. The imaging device controller 132 is configured by, for example, a sequencer or the like, and is connected to the imaging device 310 via a predetermined interface. The imaging device controller 132 has a function of controlling the imaging device 310. The computer 122, the transfer device controller 130 and the imaging device controller 132 are configured to cooperate in executing control of the transfer device 300 and the imaging device 310.

Also, as illustrated in FIG. 5, the computer 122 as an example includes a CPU 124, a storage medium 126, and an input/output interface 128. The storage medium 126 stores a program for executing control as described later. The storage medium 126 may include any volatile storage medium and/or any nonvolatile storage medium. The storage medium 126 may include, for example, one or more arbitrary storage media such as a ROM, RAM, hard disk, CD-ROM, DVD-ROM, flexible disk, and the like. The CPU 124 is configured to execute the program stored in the storage medium 126. The input/output interface 128 may include an output device such as a display, and an input device including a keyboard, a mouse and others.

Figure 6:
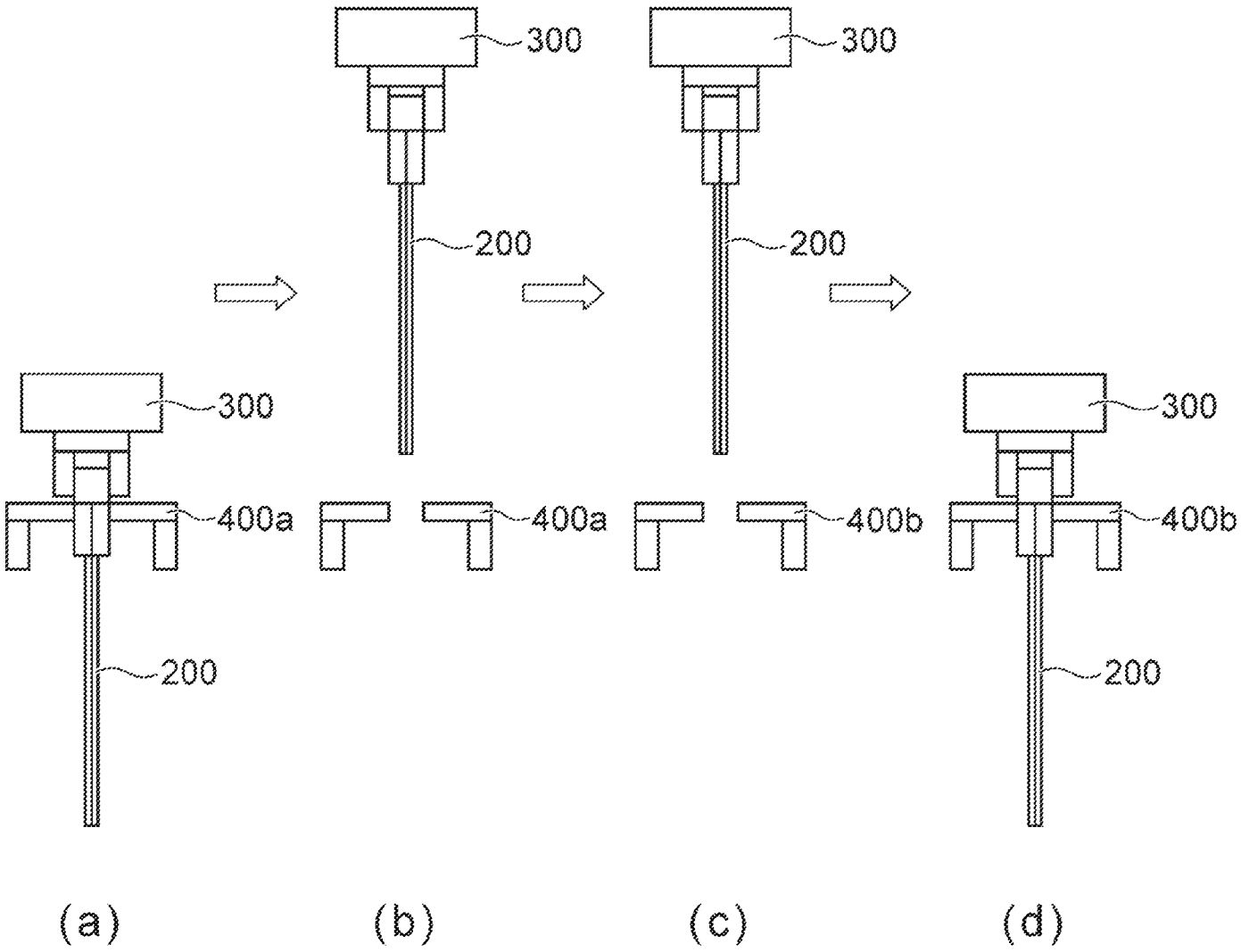
FIG. 6 is a view illustrating a transfer operation of the transfer device illustrated in FIG. 1.

As described above, in the plating apparatus 100, the transfer device 300 transfers the substrate holder 200 to each processing tank 400. FIG. 6 illustrates an example of an operation at this time. FIG. 6 are views illustrating a transfer operation of the transfer device 300. Referring to FIG. 6, first, the transfer device 300 grips the substrate holder 200 housed in one processing tank 400*a* (see FIG. 6(*a*)). The transfer device 300 then moves upward in the vertical direction, takes out the substrate holder 200 from the processing tank 400*a*, and then stops (see FIG. 6(*b*)). The transfer device 300 then moves in the transfer direction and stops directly above another processing tank 400*b* (see FIG. 6(*c*)). The transfer device 300 then moves downward in the vertical direction and houses the substrate holder 200 in the other processing tank 400*b* (see FIG. 6(*d*)). In this way, the transfer device 300 transfers the substrate holder 200 from one processing tank 400*a* to the other processing tank 400*b*.

Figure 7A:
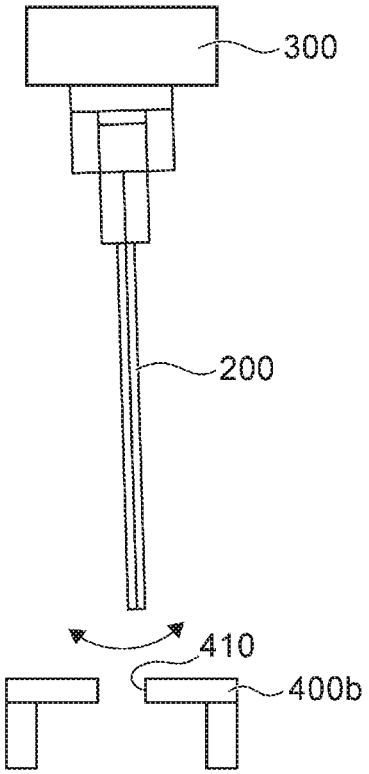
FIG. 7A is a side view illustrating swing of a substrate holder.
Figure 7B:
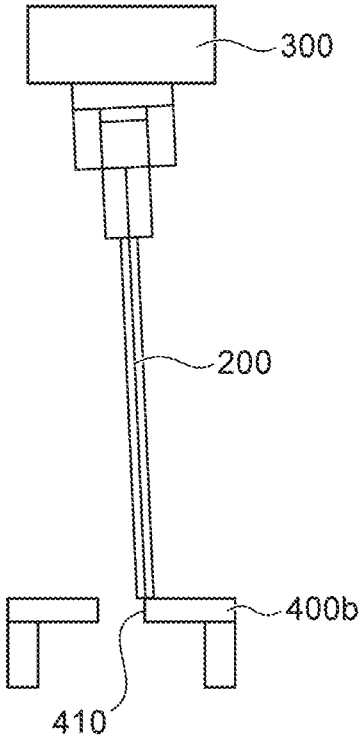
FIG. 7B is a side view illustrating contact between the substrate holder and the processing tank.

As can be seen from the above description, the transfer operation of the transfer device 300 includes a step in which the transfer device 300 gripping the substrate holder 200 moves in the transfer direction and stops above the other processing tank 400*b*. In this step, the substrate holder 200 gripped by the transfer device 300 vibrates in the transfer direction due to inertial force and may swing like a pendulum (see FIG. 7A). Then, when the transfer device 300 tries to house the noticeably vibrating substrate holder 200 in the processing tank 400*b*, the substrate holder 200 cannot pass through the opening 410 of the processing tank 400*b*, and the substrate holder 200 might come in contact with the processing tank 400*b* (edge of the opening 410) (see FIG. 7B). A magnitude of shaking of the substrate holder 200 is affected by a moving distance of the transfer device 300 in the transfer direction, an acceleration at the time of a deceleration of the transfer device 300 in the transfer direction, and the like. Then, as a magnitude of acceleration at the time of the deceleration of the transfer device 300 decreases (the transfer device 300 stops slowly), swing of the substrate holder 200 reduces. For this reason, to prevent the contact between the substrate holder 200 and the processing tank 400*b*, the magnitude of the acceleration at the time of the deceleration of the transfer device 300 may only be reduced. In the present disclosure, "the magnitude of the acceleration" means an absolute value of the acceleration.

However, if the acceleration at the time of an inappropriate deceleration that may cause contact between the substrate holder 200 and the processing tank 400*b* cannot be determined, an operator cannot determine to what value the acceleration at the time of the deceleration of the transfer device 300 is to be set. Specifically, the operator cannot determine the acceleration at the time of the deceleration of the transfer device 300 during a normal operation. For this reason, when the substrate holder 200 is transferred from the one processing tank 400*a* to the other processing tank 400*b*, it is required to determine the acceleration at the time of the inappropriate deceleration that may cause the contact between the substrate holder 200 and the processing tank 400*b*.

On the other hand, the plating apparatus 100 is configured to perform a test in a first mode as follows. Thereby, the plating apparatus 100 determines whether or not a certain test acceleration is the acceleration at the time of an inappropriate deceleration. In the test described below, a reference position as an example is the position of the transfer device 300 when the transfer device 300 stops after moving upward to take out the substrate holder 200 from the processing tank 400*a*. A determination position as an example is a position of the transfer device 300 when the transfer device 300 moves in the transfer direction and stops directly above the other processing tank 400*b*. However, in another embodiment according to the present disclosure, the reference position and the determination position may be any position where the transfer device 300 may stop. For example, the reference position and the determination position may be positions directly above the load/unload station 105, the stocker 107, the prewet module 108, the presoak module 109, the first rinse module 110*a*, the second rinse module 110*b*, the blow module 111 and the plating tank 112*a*. In the test described below, the test acceleration is constant from start of deceleration to stop and is a constant acceleration. However, in still another embodiment according to the present disclosure, the test acceleration need not be the constant acceleration. Further, when the transfer device 300 stops at the determination position, a center O of the first camera 312 and a center O of the second camera 314 are configured to be located directly above the opening 410, that is, inside a region 416 where the opening 410 is extended in the vertical direction (see FIG. 9A).

In the test, first, the control device 120 controls the first camera 312 to capture a first reference image (an example of a reference image) so that the first end portion 412 and the reference mark 402 are reflected when the transfer device 300 is located at the determination position. Furthermore, the control device 120 controls the second camera 314 to capture a second reference image (another example of the reference image) so that the second end portion 414 and the reference mark 402 are reflected when the transfer device 300 is located at the determination position. The first reference image is captured as an image illustrated in FIG. 8.

Figure 8:
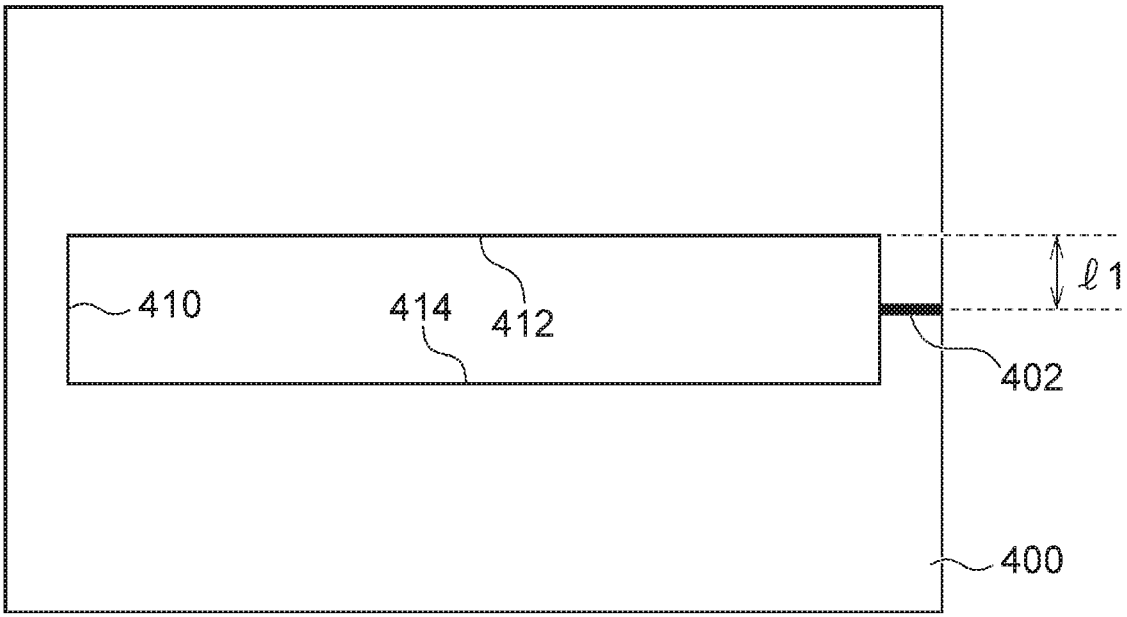
FIG. 8 is a view illustrating a first reference image.

Next, the control device 120 determines, based on the first reference image, a first threshold (an example of a threshold) from a length l1 between the reference mark 402 and the first end portion 412 in the transfer direction (see FIG. 8). At this time, the control device 120 sets, as the first threshold, the number of pixels from the reference mark 402 to the first end portion 412 in the transfer direction in the first reference image. In another embodiment, the length l1 between the reference mark 402 and the first end portion 412 in the transfer direction in the first reference image displayed on a screen may be measured, and the length l1 may be set as the first threshold. Further, the control device 120 determines, based on the second reference image, a second threshold (another example of the threshold) from a length between the reference mark 402 and the second end portion 414 in the transfer direction. At this time, the control device 120 sets, as the second threshold, the number of pixels from the reference mark 402 to the second end portion 414 in the transfer direction in the second reference image. In still another embodiment, the length between the reference mark 402 and the second end portion 414 in the transfer direction in the second reference image displayed on the screen may be measured, and the length may be set as the second threshold.

Next, the control device 120 moves the transfer device 300 from the reference position to the determination position so that the transfer device 300 gripping the substrate holder 200 decelerates at the test acceleration and stops at the determination position. As an example, the transfer device 300 moves at 1300 mm/s before decelerating. However, in a further embodiment according to the present disclosure, the transfer device 300 may move at a speed other than 1300 mm/s before decelerating.

Figure 9A:
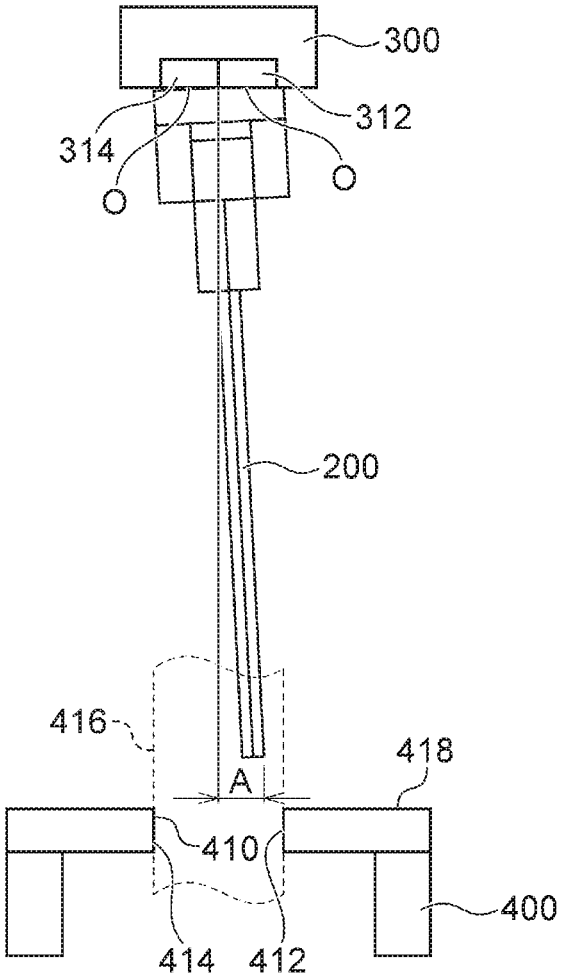
FIG. 9A is a side view of the substrate holder in a case where a lower end portion of the substrate holder does not protrude from a region.
Figure 9B:
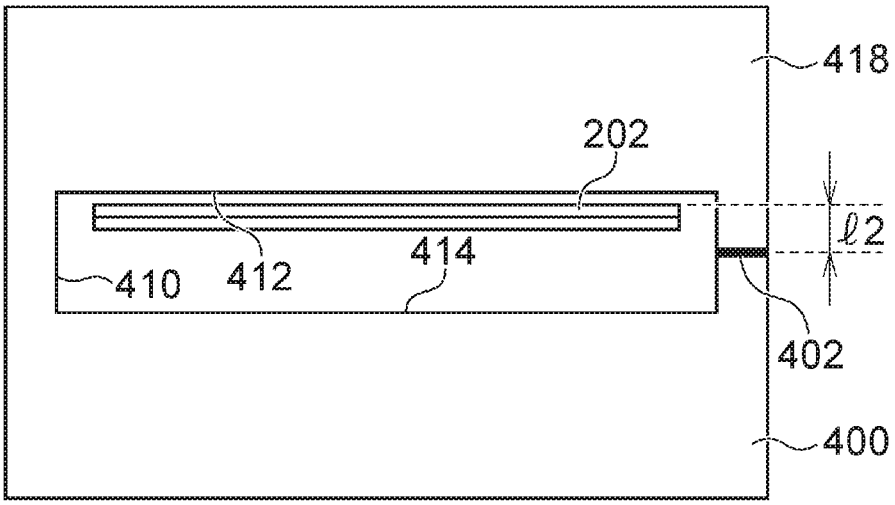
FIG. 9B is a view illustrating a first comparison video captured by a first camera of FIG. 9A.
Figure 10A:
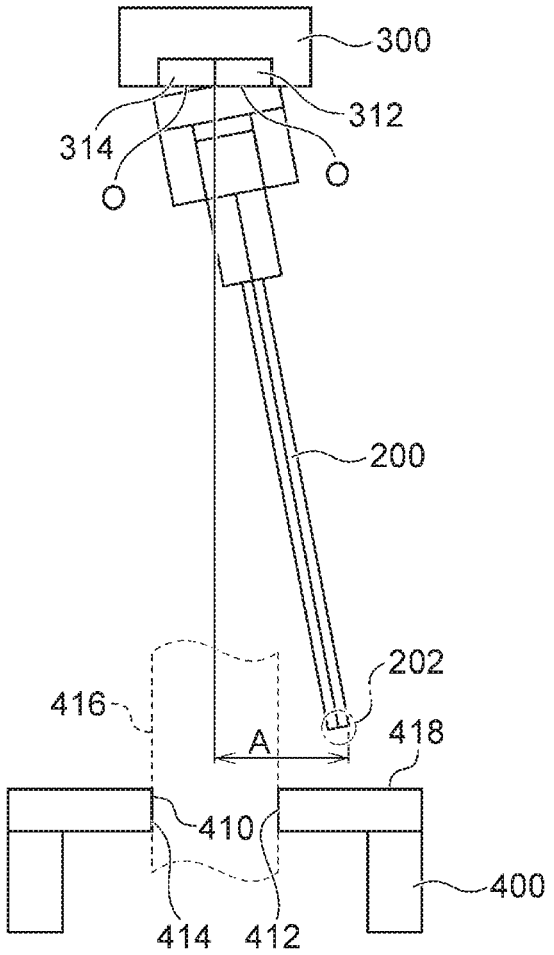
FIG. 10A is a side view of the substrate holder in a case where the lower end portion of the substrate holder protrudes from the region.
Figure 10B:
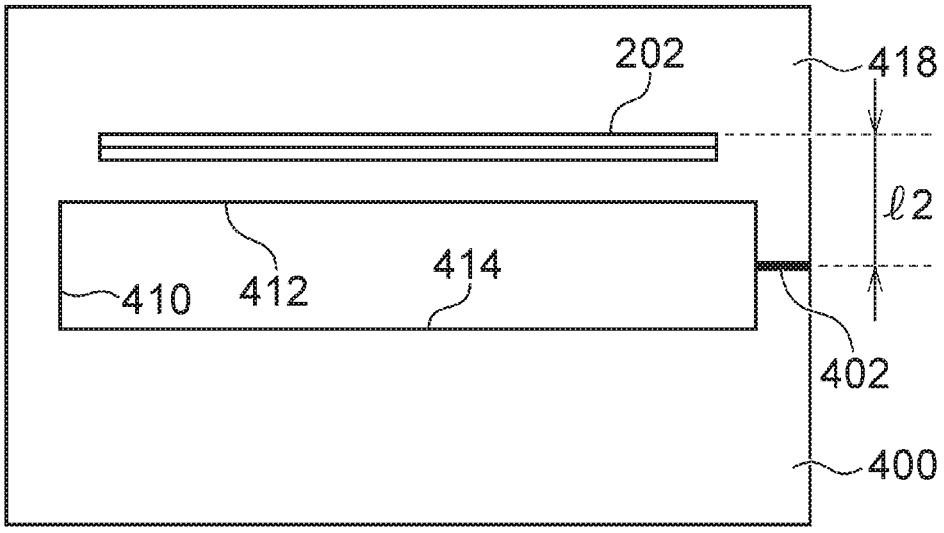
FIG. 10B is a view illustrating the first comparison video captured by the first camera of FIG. 10A.

Next, the control device 120 controls the first camera 312 to capture a first comparison video (an example of a comparison video) so that the reference mark 402 and the lower end portion 202 of the substrate holder 200 are reflected when and after the transfer device 300 stops. More specifically, the control device 120 controls the first camera 312 to capture the first comparison video from when the transfer device 300 stops until a predetermined time elapses. FIGS. 9A and 10A are side views of the substrate holder 200 after the transfer device 300 stops and are different from each other in swing width A. FIG. 9B is a view illustrating the first comparison video captured by the first camera 312 at the time of FIG. 9A, and FIG. 10B is a view illustrating the first comparison video captured by the first camera 312 at the time of FIG. 10A. FIGS. 9B and 10B do not illustrate portions of the substrate holder 200 other than the lower end portion 202 to illustrate the lower end portion 202 of the substrate holder 200. When swing of the substrate holder 200 is small, the substrate holder 200 swings as in FIG. 9A. When the swing of the substrate holder 200 is large, the substrate holder 200 swings as in FIG. 10A. Further, the control device 120 controls the second camera 314 to capture a second comparison video (another example of the comparison video) so that the reference mark 402 and the lower end portion 202 of the substrate holder 200 are reflected, when and after the transfer device 300 stops. More specifically, the control device 120 controls the second camera 314 to capture the second comparison video from when the transfer device 300 stops until a predetermined time elapses. In the present disclosure, the comparison video is composed of one or more still images.

Next, the control device 120 sequentially determines, based on the first comparison video, a first variation comparison value (an example of a variation comparison value) from a length l2 between the reference mark 402 and the lower end portion 202 of the substrate holder 200 in the transfer direction (see FIGS. 9B and 10B). At this time, the control device 120 sets, as the first variation comparison value, the number of pixels from the reference mark 402 to the lower end portion 202 of the substrate holder 200 in the transfer direction in each still image constituting the first comparison video. In another embodiment, the length l2 between the reference mark 402 and the lower end portion 202 of the substrate holder 200 in the transfer direction in each still image constituting the first comparison video displayed on the screen is measured, and the length l2 may be set as the first variation comparison value. Further, the control device 120 sequentially determines, based on the second comparison video, a second variation comparison value (another example of the variation comparison value) from the length between the reference mark 402 and the lower end portion 202 of the substrate holder 200 in the transfer direction. At this time, the control device 120 sets, as the second variation comparison value, the number of pixels from the reference mark 402 to the lower end portion 202 of the substrate holder 200 in the transfer direction in each still image constituting the second comparison video. In still another embodiment, the length between the reference mark 402 and the lower end portion 202 of the substrate holder 200 in the transfer direction in each still image constituting the second comparison video displayed on the screen is measured, and the length may be set as the second variation comparison value.

Next, the control device 120 determines by a method described later whether the lower end portion 202 of the substrate holder 200 protrudes outside the region 416 where the opening 410 is extended in the vertical direction when and after the transfer device 300 stops, based on the first reference image, the first comparison video, the second reference image, and the second comparison video (see FIGS. 9A and 10A). Then, the control device 120 determines that the test acceleration has an inappropriate value when there is concern that the lower end portion 202 of the substrate holder 200 protrudes outside the region 416. The plating apparatus 100 performs the test as described above.

Even on the same operating conditions, the swing width A of the substrate holder 200 may not necessarily be the same. For this reason, the control device 120 moves several times the transfer device 300 from the reference position to the determination position so that the transfer device 300 decelerates at the test acceleration and stops at the determination position and may determine that the test acceleration has the inappropriate value when there is concern that the lower end portion 202 protrudes outside the region 416 even once. At this time, the control device 120 may include a configuration where the operator can change setting of the number of times the control device 120 moves the transfer device 300 from the reference position to the determination position. The number of the times may be two or three.

As can be seen from the above description, the control device 120 determines that the test acceleration has the inappropriate value when there is concern that the lower end portion 202 protrudes outside the region 416 when and after the transfer device 300 stops (see FIG. 10A). This reason will be described with reference to FIGS. 9A and 10A. In FIG. 9A, the lower end portion 202 of the substrate holder 200 does not protrude from the region 416. In this state, when the transfer device 300 moves downward in the vertical direction, the lower end portion 202 of the substrate holder 200 can clearly pass through the opening 410 of the processing tank 400. On the other hand, in FIG. 10A, the lower end portion 202 of the substrate holder 200 protrudes from the region 416. Then, directly below the lower end portion 202 of the substrate holder 200, a plate surface 418 of the processing tank 400 is located. For this reason, in this state, when the transfer device 300 moves downward in the vertical direction, the lower end portion 202 of the substrate holder 200 cannot pass through the opening 410 of the processing tank 400 and comes in contact with the processing tank 400. Therefore, determining conditions of the control device 120 are appropriate, and the plating apparatus 100 can determine the acceleration at the time of the inappropriate deceleration that may cause the contact between the substrate holder 200 and the processing tank 400.

Further, the operator can determine whether or not the lower end portion 202 of the substrate holder 200 protrudes outside the region 416 where the opening 410 of the processing tank 400 is extended in the vertical direction, also by visually confirming swing of the substrate holder 200. However, when such a determination is made by the operator's visual check, it takes time for the operator to determine, and there is concern that an operation time is extended. On the other hand, the plating apparatus 100 does not require the visual check by the operator for the determination. Specifically, the plating apparatus 100 can make the time required for the operation of determining the acceleration at the time of the inappropriate deceleration shorter than for the operator's operation performed by the visual check.

In one embodiment according to the present disclosure, in the above test, the control device 120 compares the first threshold and the first variation comparison value and considers that the lower end portion 202 of the substrate holder 200 protrudes outside the region 416, when the first variation comparison value exceeds the first threshold. Thereby, when the lower end portion 202 of the substrate holder 200 protrudes outside the region 416 from a side of the first end portion 412 (see FIG. 10A), the control device 120 can definitely determine that the lower end portion 202 protrudes from the region 416. This reason will be described with reference to FIGS. 11A to 15B.

Figure 11A:
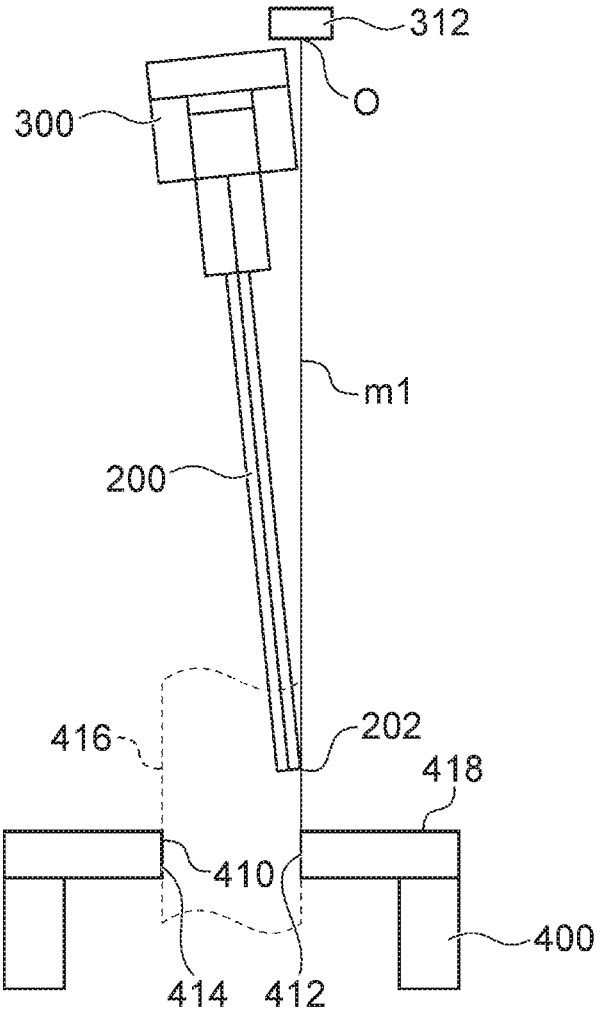
FIG. 11A is a side view of the substrate holder.
Figure 11B:
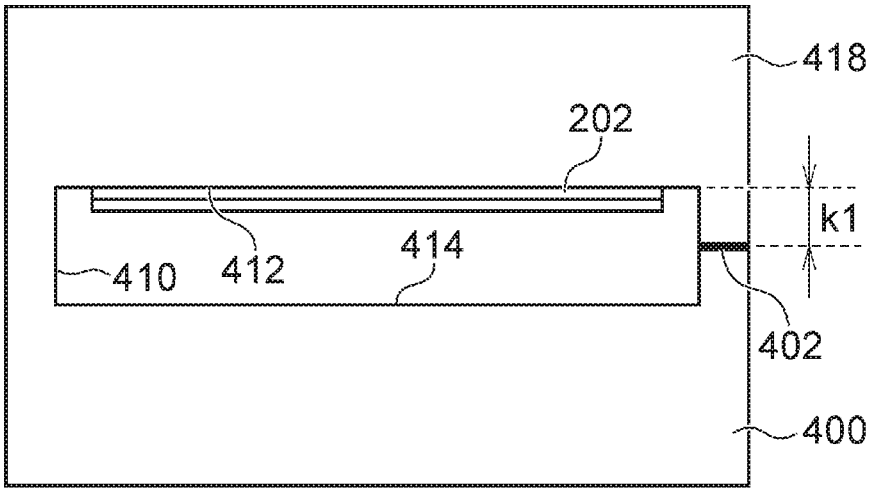
FIG. 11B is a view illustrating a first comparison video captured at the time of FIG. 11A.
Figure 12A:
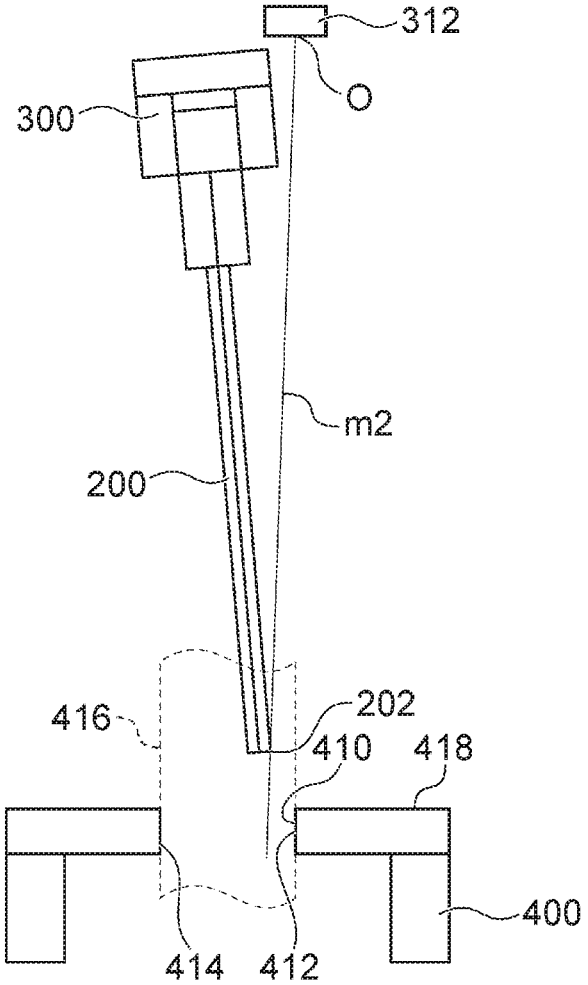
FIG. 12A is a side view of the substrate holder.
Figure 12B:
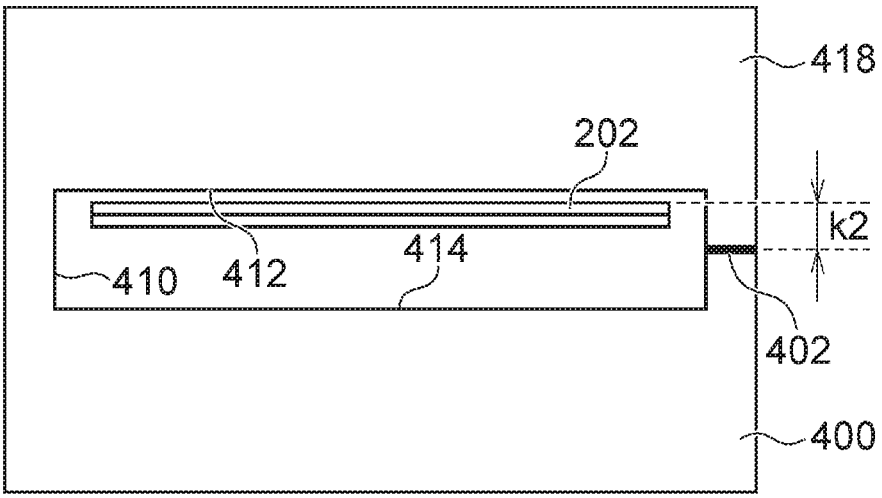
FIG. 12B is a view illustrating a first comparison video captured at the time of FIG. 12A.
Figure 13A:
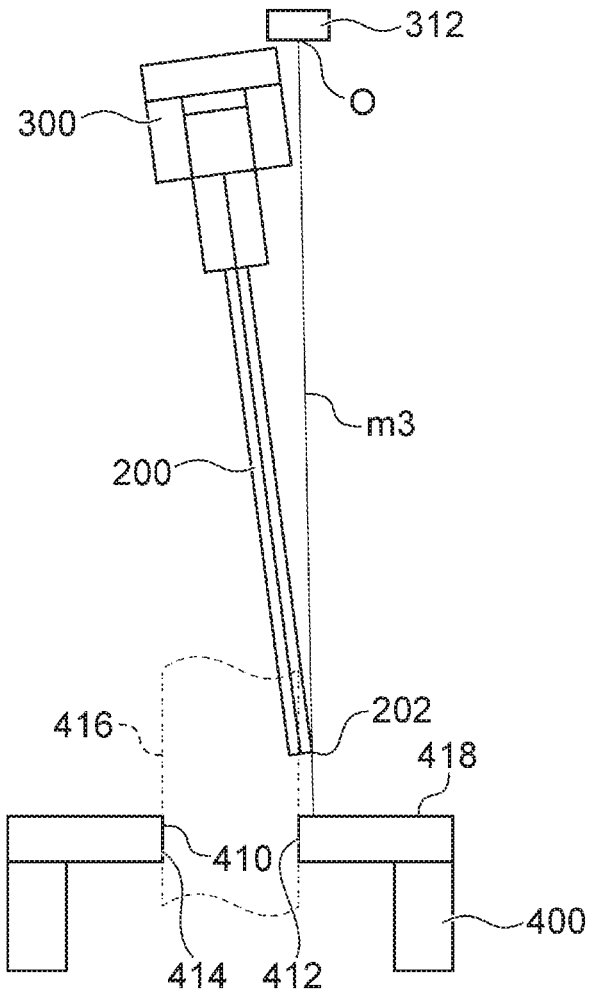
FIG. 13A is a side view of the substrate holder.
Figure 13B:
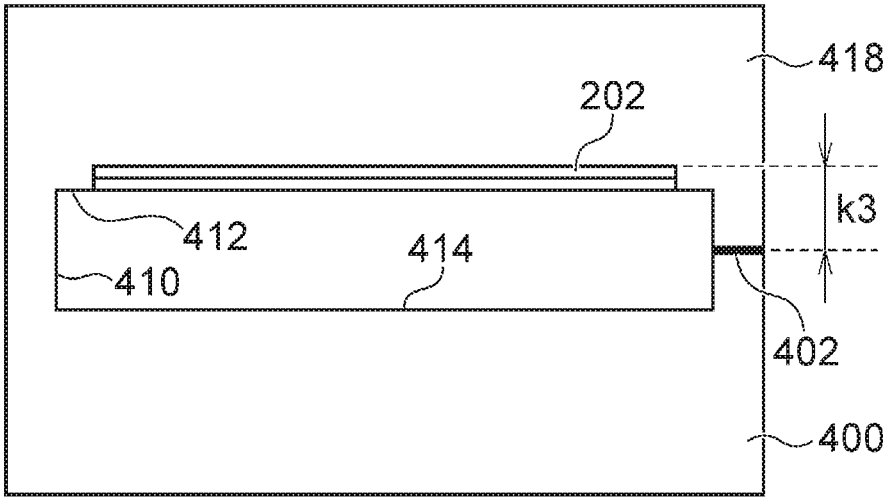
FIG. 13B is a view illustrating a first comparison video captured at the time of FIG. 13A.

FIGS. 11A, 12A and 13A are side views of the substrate holder 200 and illustrate states where the swing of the substrate holder 200 is different. FIGS. 11B, 12B and 13B are views illustrating first comparison videos captured in the states of FIGS. 11A, 12A and 13A, respectively. In FIGS. 11A, 12A and 13A, the center O of the first camera 312 is located directly above the first end portion 412. FIGS. 11B, 12B and 13B do not illustrate portions of the substrate holder 200 other than the lower end portion 202 to illustrate the lower end portion 202 of the substrate holder 200.

FIG. 11A illustrates the state where the lower end portion 202 of the substrate holder 200 is located directly above the first end portion 412. Referring to FIG. 11A, a straight line m1 connecting the center O of the first camera 312 and the lower end portion 202 of the substrate holder 200 passes through the first end portion 412. For this reason, in the first comparison video captured at the time of FIG. 11A, the lower end portion 202 overlaps with the first end portion 412 (see FIG. 11B). Therefore, in the state illustrated in FIG. 11A, a length k1 from the reference mark 402 to the lower end portion 202 in the transfer direction is equal to the length l1 from the reference mark 402 to the first end portion 412 (see FIG. 8). Specifically, the first variation comparison value is equal to the first threshold.

FIG. 12A illustrates the state where the lower end portion 202 of the substrate holder 200 does not protrude outside the region 416. Referring to FIG. 12A, a straight line m2 connecting the center O of the first camera 312 and the lower end portion 202 of the substrate holder 200 passes through the opening 410. For this reason, in the first comparison video captured at the time of FIG. 12A, the lower end portion 202 overlaps with the opening 410 (see FIG. 12B). Therefore, in the state illustrated in FIG. 12A, a length k2 from the reference mark 402 to the lower end portion 202 in the transfer direction is shorter than the length l1 from the reference mark 402 to the first end portion 412 (see FIG. 8). Specifically, the first variation comparison value is smaller than the first threshold.

FIG. 13A illustrates the state where the lower end portion 202 of the substrate holder 200 protrudes outside the region 416. Referring to FIG. 13A, a straight line m3 connecting the center O of the first camera 312 and the lower end portion 202 of the substrate holder 200 passes through the plate surface 418. For this reason, in the first comparison video captured at the time of FIG. 13A, the lower end portion 202 overlaps with the plate surface 418 (see FIG. 13B). Therefore, in the state illustrated in FIG. 13A, a length k3 from the reference mark 402 to the lower end portion 202 in the transfer direction is longer than the length l1 from the reference mark 402 to the first end portion 412 (see FIG. 8). Specifically, the first variation comparison value is larger than the first threshold.

From the above, when the center O of the first camera 312 is located directly above the first end portion 412 and when the first variation comparison value exceeds the first threshold, it can be seen that the lower end portion 202 of the substrate holder 200 protrudes outside the region 416.

Figure 14A:
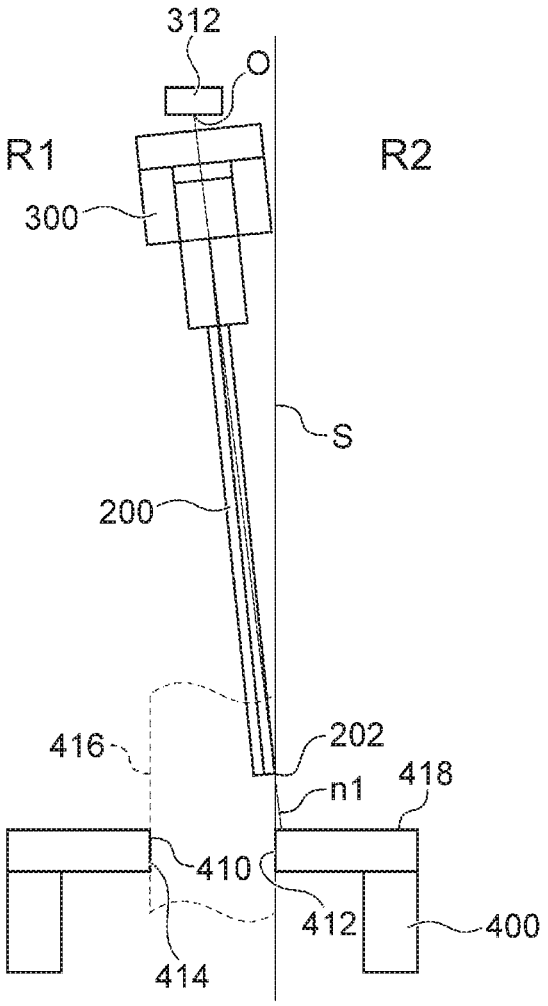
FIG. 14A is a side view of the substrate holder.
Figure 14B:
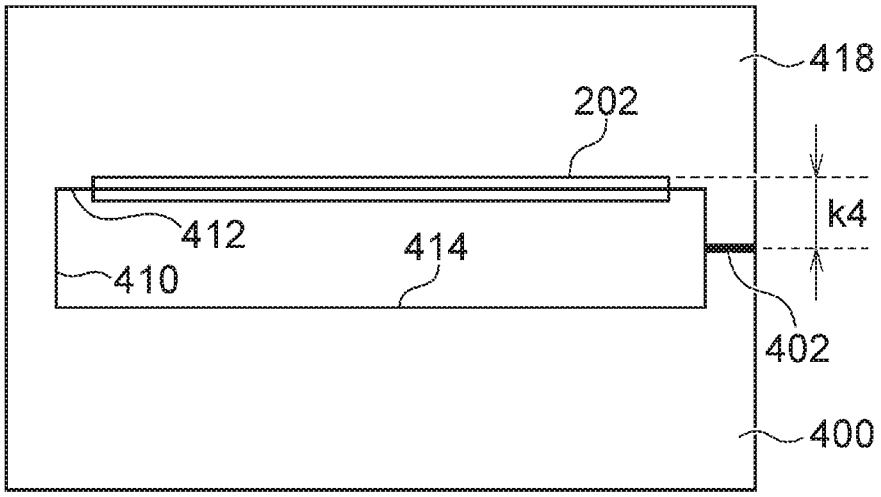
FIG. 14B is a view illustrating a first comparison video captured at the time of FIG. 14A.
Figure 15A:
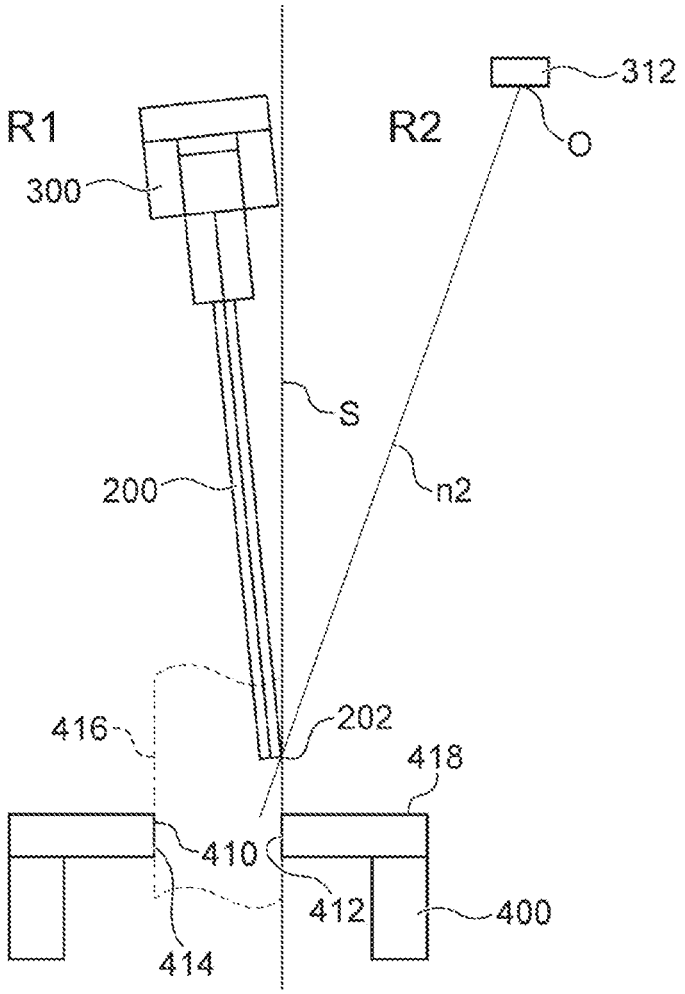
FIG. 15A is a side view of the substrate holder.
Figure 15B:
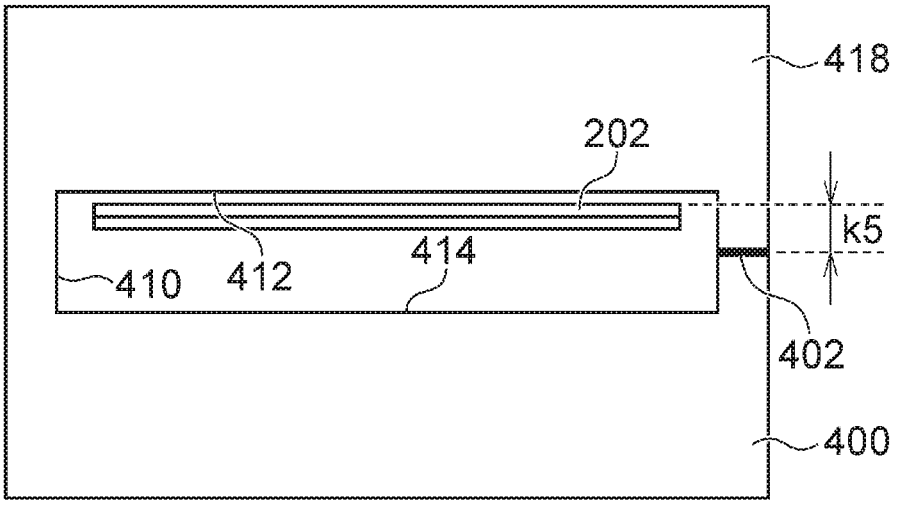
FIG. 15B is a view illustrating a first comparison video captured at the time of FIG. 15A.

Next, refer to FIGS. 14A to 15B. FIGS. 14A and 15A are side views of the substrate holder 200 and illustrate states where positions of the center O of the first camera 312 are different from each other. FIGS. 14B and 15B are views illustrating first comparison videos captured in the states of FIGS. 14A and 15A, respectively. In FIGS. 14A and 15A, the lower end portion 202 of the substrate holder 200 is located directly above the first end portion 412. FIGS. 14B and 15B do not illustrate portions of the substrate holder 200 other than the lower end portion 202 to illustrate the lower end portion 202 of the substrate holder 200.

In FIG. 14A, the center O of the first camera 312 is located directly above the opening 410. Specifically, the center O of the first camera 312 is located in a region R1 on a side on which the second end portion 414 is located out of two regions R1 and R2 divided by a vertical plane S passing through the first end portion 412. Referring to FIG. 14A, a straight line n1 connecting the center O of the first camera 312 and the lower end portion 202 of the substrate holder 200 passes through the plate surface 418 of the processing tank 400. For this reason, in the first comparison video captured at the time of FIG. 14A, the lower end portion 202 overlaps with the plate surface 418 (see FIG. 14B). Therefore, in the state illustrated in FIG. 14A, a length k4 from the reference mark 402 to the lower end portion 202 in the transfer direction is longer than the length l1 from the reference mark 402 to the first end portion 412 (see FIG. 8). Specifically, the first variation comparison value is larger than the first threshold. Then, when the lower end portion 202 of the substrate holder 200 protrudes outside the region 416, the first variation comparison value further increases.

Thus, when the center O of the first camera 312 is located inside the region R1 without being located directly above the first end portion 412 and even when the first variation comparison value is larger than the first threshold, the lower end portion 202 of the substrate holder 200 may not protrude outside the region 416. However, when the first variation comparison value is smaller than the first threshold, the lower end portion 202 of the substrate holder 200 definitely does not protrude outside the region 416 from the side of the first end portion 412.

As described above, in the plating apparatus 100, the center O of the first camera 312 is located directly above the opening 410. Specifically, the center O is located inside the region R1. Then, the control device 120 considers that the lower end portion 202 of the substrate holder 200 protrudes outside the region 416, when the first variation comparison value exceeds the first threshold. From this, although the control device 120 may determine that the lower end portion 202, which does not protrude outside the region 416 from the side of the first end portion 412, protrudes, the control device can determine that the lower end portion 202 protruding outside the region 416 definitely protrudes. Then, the plating apparatus 100 determines that the test acceleration has the inappropriate value, when there is concern that the lower end portion 202 of the substrate holder 200 protrudes outside the region 416. Specifically, the plating apparatus 100 can determine the acceleration at the time of the inappropriate deceleration of the transfer device 300 that may cause the contact between the substrate holder 200 and the processing tank 400.

On the other hand, in FIG. 15A, the center O of the first camera 312 is located inside the region R2. Referring to FIG. 15A, a straight line n2 connecting the center O of the first camera 312 and the lower end portion 202 of the substrate holder 200 passes through the opening 410. For this reason, in the first comparison video captured at the time of FIG. 15A, the lower end portion 202 overlaps with the opening 410 (see FIG. 15B). Therefore, in the state illustrated in FIG. 15A, a length k5 from the reference mark 402 to the lower end portion 202 in the transfer direction is shorter than the length l1 from the reference mark 402 to the first end portion 412 (see FIG. 8). Specifically, the first variation comparison value is smaller than the first threshold.

Thus, when the center O of the first camera 312 is located in the region R2 and when the lower end portion 202 protrudes, the first variation comparison value may not exceed the first threshold. For this reason, when determination is made using the first comparison value and the first threshold, it is preferable that the first camera 312 is located in the region R1.

In the above test, the control device 120 compares the second threshold and the second variation comparison value and determines that the lower end portion 202 of the substrate holder 200 protrudes outside the region 416, when the second variation comparison value exceeds the second threshold. Thereby, when the lower end portion 202 of the substrate holder 200 protrudes outside the region 416 from the side of the second end portion 414, the control device 120 can definitely determine that the portion protrudes. A reason for this is the same as the reason why the control device 120 can definitely determine that the lower end portion 202 protrudes when the lower end portion 202 protrudes outside the region 416 from the side of the first end portion 412, and hence this reason is not described.

The swing of the substrate holder 200 is related to the acceleration at the time of the deceleration of the transfer device 300, and when the magnitude of the acceleration decreases, the magnitude of the swing of the substrate holder 200 also decreases. For this reason, if the magnitude of the test acceleration decreases in the above test, the test acceleration is difficult to be distinguished from the acceleration at the time of the inappropriate deceleration. However, when the magnitude of the acceleration at the time of the deceleration of the transfer device 300 decreases during the normal operation, a time required until the transfer device 300 stops increases. As a result, a longer time is required for the transfer of the substrate holder 200, and there is concern that a processing amount of the substrate W by the plating apparatus 100 decreases. For this reason, in order to suppress a decrease in processing amount, it is required not to reduce the magnitude of the acceleration at the time of the deceleration of the transfer device 300 more than necessary. In the present disclosure, it is indicated that during the normal operation, the plating apparatus 100 performs an operation of plating the substrate W.

In contrast, in one embodiment according to the present disclosure, the control device 120 is configured to execute the above test at a plurality of test accelerations and to find the acceleration having a larger magnitude that is not distinguished from the acceleration at the time of the inappropriate deceleration. Specifically, the control device 120 is configured to repeatedly execute the above test at a plurality of accelerations in order from the acceleration with the largest magnitude of the acceleration until a test acceleration that is not determined to have an inappropriate value is found. Then, the control device 120 is configured to output or store, as a maximum allowable acceleration, the test acceleration that is not determined to have the inappropriate value and that is first found as a result of the repetition.

The maximum allowable acceleration is the acceleration that is not determined to have the inappropriate value and that has the largest magnitude among the accelerations at which the plating apparatus 100 performs the test. For this reason, when the maximum allowable acceleration is set as a set value of an acceleration at the time of a deceleration applied to the transfer device 300 and when the plating apparatus 100 performs the normal operation, the processing amount does not unnecessarily decrease. Specifically, the plating apparatus 100 can obtain the set value of the acceleration at the time of an optimum deceleration that can suppress contact between the substrate holder 200 and the processing tank 400 and suppress unnecessary decrease in processing amount.

Also, during the normal operation, the transfer device 300 transfers the substrate holder 200 through a plurality of routes such as a route from the load/unload station 105 to the prewet module 108 and a route from the prewet module 108 to the presoak module 109. For this reason, to perform the normal operation, it is necessary that the set value of the acceleration at the time of a deceleration for each route is input to the control device 120 of the plating apparatus 100. Specifically, not only the set value of the acceleration at the time of the optimum deceleration in one route (route from one reference position to one determination position) but also the acceleration at the time of the optimum deceleration in a plurality of routes are required.

Figure 16:
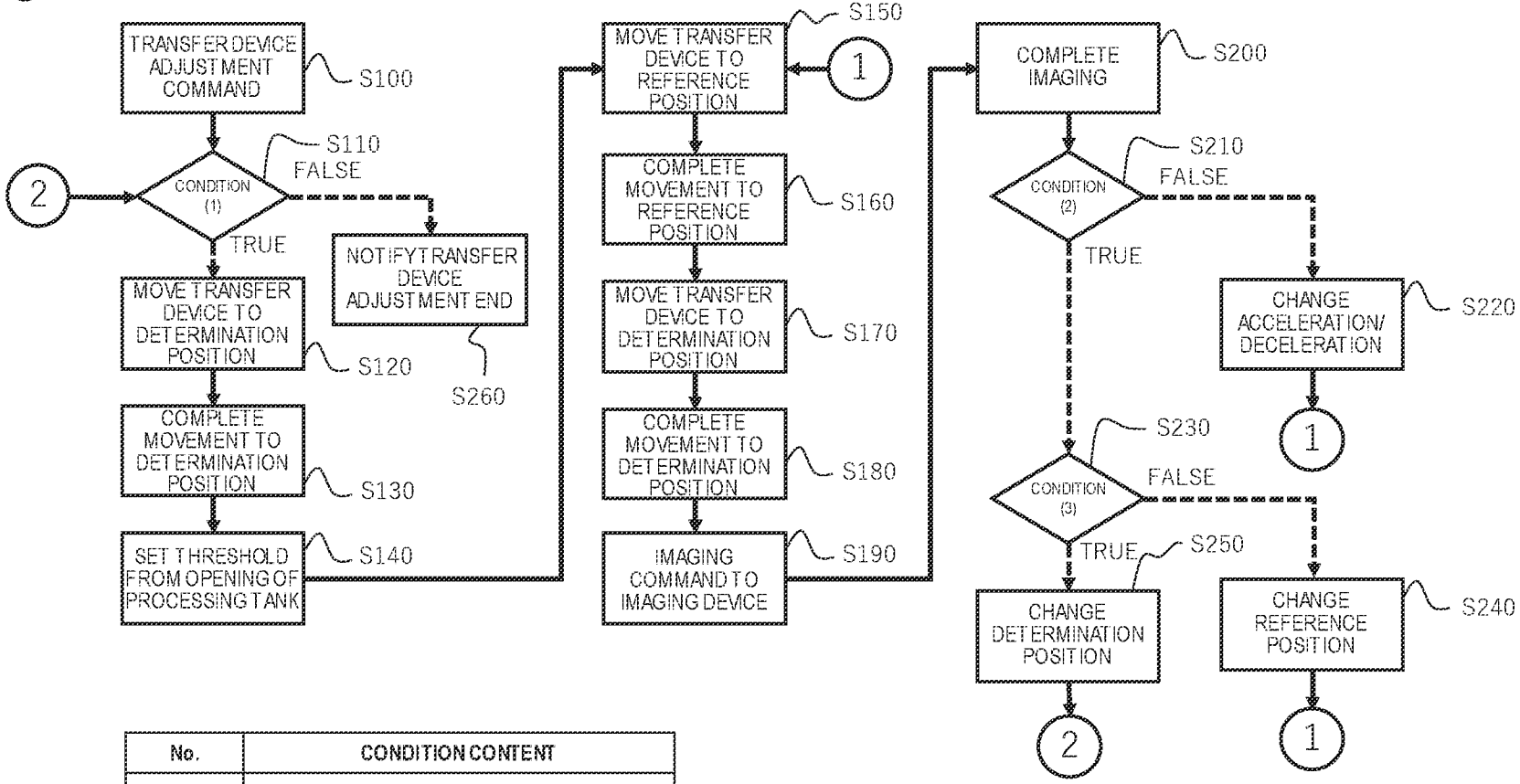
FIG. 16 is a flowchart illustrating a procedure of control processing during an operation of the plating apparatus illustrated in FIG. 1.

On the other hand, the plating apparatus 100 operates according to a control flow illustrated in FIG. 16 and can obtain the acceleration at the time of the optimum deceleration in a plurality of routes (routes from a plurality of reference positions to a plurality of determination positions).

With reference to FIG. 16, an example of the operation of the plating apparatus 100 will be described.

Referring to FIG. 16, first, in step S100, when the computer 122 receives a transfer device adjustment command, the computer 122 starts operation. In the computer 122, testing route information (information indicating that the test is performed from which reference position to which transfer position) is input in advance. The computer 122 may be configured so that the operator can input this information to the computer 122.

Next, in step S110, it is determined whether or not there is a determination position at which the test is not performed. Then, if there is the determination position at which the test is not performed, a process proceeds to step S120. On the other hand, if there is no determination position at which the test is not performed, the process proceeds to step S260.

When the process proceeds to step S120, the transfer device controller 130 moves the transfer device 300 to a set determination position. Next, in step S130, the transfer device 300 arrives at the set determination position and completes the movement.

Next, in step S140, the imaging device controller 132 controls the imaging device 310 to capture a reference image. The computer 122 then sets a threshold based on the reference image.

Then, in step S150, the transfer device controller 130 moves the transfer device 300 to a set reference position. Next, in step S160, the transfer device 300 arrives at the set reference position and completes the movement.

Then, in step S170, the transfer device controller 130 moves the transfer device 300 from the set reference position to the set determination position so that the transfer device 300 gripping the substrate holder 200 decelerates at the set test acceleration and stops at the determination position. Next, in step S180, the transfer device 300 arrives at the set reference position and completes the movement.

Next, in step S190, the imaging device controller 132 controls the imaging device 310 to capture a comparison video. Next, in step S200, the imaging device 310 completes imaging.

Next, in step S210, the computer 122 determines the variation comparison value based on the comparison video. Then, the computer compares a value when the variation comparison value is maximized and the threshold. As a result, if the value when the variation comparison value is maximized is equal to or less than the threshold, the process proceeds to step S230. On the other hand, if the value when the variation comparison value is maximized is larger than the threshold, the process proceeds to step S220.

When the process proceeds to step S220, the set magnitude of the test acceleration is reduced by a predetermined amount. Thereafter, the process proceeds to step S150, and the process from step S220 to step S210 is repeated according to the flow of FIG. 16 until the value when the variation comparison value is maximized becomes equal to or less than the threshold.

Then, if the value when the variation comparison value is maximized becomes equal to or less than the threshold, the process proceeds from step S210 to step S230, and it is determined whether or not there is the reference position at which the test is not performed. If there is not any reference position at which the test is not performed, the process proceeds to step S250. On the other hand, if there is the reference position at which the test is not performed, the process proceeds to step S240.

When the process proceeds to step S240, the computer 122 changes the set reference position to the position at which the test is not performed. Next, the process proceeds to step S150, and the process from step S240 to step S230 is repeated according to the flow of FIG. 16 until the reference position at which the test is not performed disappears.

Then, when the reference position at which the test is not performed disappears, the process proceeds from step S230 to step S250, and the computer 122 changes the set determination position to a position at which the test is not performed. Thereafter, the process proceeds to step S110, and the process from step S120 to step S110 is repeated according to the flow of FIG. 16 until the determination position at which the test is not performed disappears.

Then, when the determination position at which the test is not performed disappears, the process proceeds from step S110 to step S260. Then, in step S260, the computer 122 notifies end of transfer device adjustment.

The plating apparatus 100 operates as above. Thereby, the plating apparatus 100 can automatically obtain the acceleration at the time of the optimum deceleration in a plurality of routes (routes from a plurality of reference positions to a plurality of determination positions).

As described above, the plating apparatus 100 can determine the acceleration at the time of the inappropriate deceleration that may cause contact between the substrate holder 200 and the processing tank 400. Therefore, during the normal operation, if the transfer device 300 decelerates at an acceleration having a magnitude smaller than the magnitude of the acceleration at the time of the inappropriate deceleration, the contact between the substrate holder 200 and the processing tank 400 can be suppressed. However, the swing width of the substrate holder 200 may vary even on the same operating conditions. Therefore, even if the transfer device 300 decelerates at an acceleration having a magnitude smaller than the magnitude of the acceleration at the time of the inappropriate deceleration, contact between the substrate holder 200 and the processing tank 400 cannot be completely prevented. The conditions of the plating apparatus 100 may change due to deterioration in conditions of the hand and main body of the transfer device 300 and the substrate holder 200, poor calibration/adjustment after replacing parts, or the like. In such a case, there may occur a change in swing of the substrate holder 200 when the transfer device 300 stops. As a result, even if the transfer device 300 decelerates at an acceleration having a magnitude smaller than the magnitude of the acceleration at the time of the inappropriate deceleration and stops, there is concern that the substrate holder 200 and the processing tank 400 come in contact. The plating apparatus 100 has a second mode and prevents such contact by being set to the second mode during the normal operation. Hereinafter, an example of the operation of the plating apparatus 100 in the second mode will be described.

During the normal operation, the transfer device 300 needs to transfer the substrate holder 200 from one processing tank 400 to another processing tank 400. For this reason, in the second mode, the control device 120 moves the transfer device 300 gripping the substrate holder 200 from the one processing tank 400 to the other processing tank 400. Specifically, the control device 120 moves the transfer device 300 gripping the substrate holder 200 from the reference position to the determination position and stops the transfer device 300 at the reference position in the same manner as in the first mode. The reference position and the determination position in the second mode match the reference position and the determination position in the test of the first mode, respectively. Then, the control device 120 controls the first camera 312 to capture a third comparison video so that the reference mark 402 and the lower end portion 202 of the substrate holder 200 are reflected, when and after the transfer device 300 stops. Further, the control device 120 controls the second camera 314 to capture a fourth comparison video so that the reference mark 402 and the lower end portion 202 of the substrate holder 200 are reflected.

Next, the control device 120 sequentially determines, based on the third comparison video, a third variation comparison value from the length between the reference mark 402 and the lower end portion 202 of the substrate holder 200 in the transfer direction. Further, the control device 120 sequentially determines, based on the fourth comparison video, a fourth variation comparison value from the length between the reference mark 402 and the lower end portion 202 of the substrate holder 200 in the transfer direction. Next, the control device 120 stops the transfer device 300 and rings alarm, when the third variation comparison value exceeds the first threshold or when the fourth variation comparison value exceeds the second threshold. The first threshold and the second threshold in the second mode match the first threshold and the second threshold determined in the first mode.

As can be seen from the above description, in the second mode, the control device 120 stops the transfer device 300 and does not move the transfer device 300 downward from the determination position, when the third variation comparison value exceeds the first threshold or when the fourth variation comparison value exceeds the second threshold. Specifically, when the lower end portion 202 of the substrate holder 200 protrudes from the region 416, the control device 120 does not move the transfer device 300 downward from the determination position. Thereby, even if the conditions of the plating apparatus 100 change, the plating apparatus 100 can prevent the contact between the substrate holder 200 and the processing tank 400.

Further, the opening 410 of the processing tank 400 may be closed with a lid. Then, when the transfer device 300 houses the substrate holder 200 in the processing tank 400 and when the opening 410 of the processing tank 400 is closed, the substrate holder 200 comes in contact with the lid. In such a case, the substrate holder 200, the processing tank 400, the lid and the like may be damaged. The plating apparatus 100 has a third mode to prevent such damages. The control device 120 is configured to perform control in the third mode as follows.

In the third mode, first, the control device 120 controls the imaging device 310 to capture a first reference still image that is an image of the opening 410 of the processing tank 400, when the substrate holder 200 can enter the processing tank 400 through the opening 410.

Next, the control device 120 controls the imaging device 310 to capture a first comparison still image that is the image of the opening 410 of the processing tank 400 from a position at which the first reference still image is captured, before the transfer device 300 transfers the substrate holder 200 into the processing tank 400. Next, the control device 120 compares the first reference still image and the first comparison still image, and when a match rate between the first reference still image and the first comparison still image becomes equal to or less than a predetermined value, the control device stops the transfer device 300. The match rate is a ratio of pixels that match among all pixels, which is obtained by comparing respective pixels constituting the first reference still image with respective pixels constituting the first comparison still image. The predetermined value may be 97%, 95%, 90%, 80%, 70% or the like.

When the match rate between the first reference still image and the first comparison still image is low, there is a high possibility that a foreign object such as the lid is placed over the opening 410 and that the opening 410 is closed. In the third mode, as described above, the transfer device 300 stops when the match rate between the first reference still image and the first comparison still image is equal to or less than the predetermined value. For this reason, in the plating apparatus 100, when there is a high possibility that the opening 410 is closed, the transfer device 300 does not transfer the substrate holder 200 into the processing tank 400. That is, the plating apparatus 100 can suppress contact between the substrate holder 200 and the foreign object.

The plating apparatus 100 has a fourth mode. The control device 120 is configured to perform control in the fourth mode as follows.

In the fourth mode, first, the control device 120 controls the imaging device 310 to capture a second reference still image that is an image of the stocker 107 when the substrate holder 200 is housed in the stocker 107. Further, when the control device 120 is to acquire loading information of the substrate holder 200 in the stocker 107, the control device controls the imaging device 310 to capture a second comparison still image that is an image of the stocker 107 from a position at which the second reference still image is captured. Then, the control device 120 determines that the substrate holder 200 is housed in the stocker 107 when the match rate between the second reference still image and the second comparison still image is equal to or more than the predetermined value. On the other hand, the control device 120 determines that the substrate holder 200 is not housed in the stocker 107 when the match rate between the second reference still image and the second comparison still image is less than the predetermined value. Thereafter, the control device 120 outputs or stores the loading information of the substrate holder 200 in the stocker 107. Thereby, the plating apparatus 100 can obtain the loading information of the substrate holder 200 in the stocker 107. The match rate is a ratio of pixels that match among all pixels, which is obtained by comparing respective pixels constituting the second reference still image with respective pixels constituting the second comparison still image. The predetermined value for use in the fourth mode may be 97%, 95%, 90%, 80%, 70% or the like.

Supplements

Some or all of the above embodiments may also be described as in supplements as follows and are not limited to the following supplements.

(Supplement 1)

A plating apparatus according to Supplement 1 is a plating apparatus including a transfer device for transferring a substrate holder in a vertical direction and a transfer direction perpendicular to the vertical direction, the transfer device including an imaging device, a processing tank having an opening for the substrate holder to be put inside, a reference mark, and a control device that controls the transfer device and the imaging device, the plating apparatus having a first mode in which the control device is configured to execute a test at a test acceleration, and the test includes: controlling, by the control device, the imaging device to capture a reference image so that the opening and the reference mark are reflected, when the transfer device is located at a determination position directly above the processing tank; moving, by the control device, the transfer device from a reference position to the determination position so that the transfer device gripping the substrate holder decelerates at the test acceleration and stops at the determination position; controlling, by the control device, the imaging device to capture a comparison video so that the reference mark and a lower end portion of the substrate holder are reflected, when and after the transfer device stops; and determining, by the control device, whether the lower end portion of the substrate holder protrudes outside a region where the opening is extended in the vertical direction when and after the transfer device stops, based on the reference image and the comparison video, to determine that the test acceleration has an inappropriate value when the lower end portion protrudes outside the region.

In the plating apparatus according to Supplement 1, it is determined whether the lower end portion of the substrate holder protrudes outside the region where the opening is extended in the vertical direction when and after the transfer device stops at the determination position, and it is determined that the test acceleration has the inappropriate value when the lower end portion protrudes outside the region. Specifically, this plating apparatus can determine an acceleration at the time of an inappropriate deceleration that may cause contact between the substrate holder and the processing tank.

An operator can determine whether or not the lower end portion of the substrate holder protrudes outside the region where the opening of the processing tank is extended in the vertical direction, also by visually confirming swing of the substrate holder. However, when such a determination is made by the operator's visual check, it takes time for the operator to determine, and there is concern that an operation time is extended.

On the other hand, the plating apparatus according to Supplement 1 does not require the visual check by the operator. As a result, the plating apparatus according to Supplement 1 can make a time required for an operation of determining the acceleration at the time of the inappropriate deceleration shorter than for an operator's operation of performing visual check.

(Supplement 2)

According to the plating apparatus of Supplement 2, in the plating apparatus according to Supplement 1, the test acceleration is constant from start of deceleration to stop.

(Supplement 3)

According to the plating apparatus of Supplement 3, in the plating apparatus according to Supplement 2, the control device is configured to execute the test at a plurality of test accelerations, the control device repeatedly executes the test at the test accelerations in order from the test acceleration with the largest magnitude until the test acceleration that is not determined to have an inappropriate value is found, and the control device outputs or stores, as a maximum allowable acceleration, the test acceleration that is not determined to have the inappropriate value and that is first found as a result of the repetition.

According to the plating apparatus of Supplement 3, from accelerations with a plurality of different values, the test acceleration that is not determined to have the inappropriate value and that has the largest magnitude can be found as the maximum allowable acceleration. Specifically, since the maximum allowable acceleration is the test acceleration that is not determined to have the inappropriate value and that has the largest magnitude, a processing amount can be prevented from being reduced more than necessary.

(Supplement 4)

According to the plating apparatus of Supplement 4, in the plating apparatus according to any one of Supplements 1 to 3, the opening has a first end portion extending on a first straight line orthogonal to the transfer direction and the vertical direction, and a second end portion extending on a second straight line parallel to the first straight line, the imaging device includes a first camera that images the lower end portion of the substrate holder, the first end portion and the reference mark, the control device controls the first camera, the reference mark is located between the first straight line and the second straight line in the transfer direction, and when the transfer device is located at the determination position, a center of the first camera is located directly above the opening, and the test includes controlling, by the control device, the first camera to capture a first reference image so that the first end portion and the reference mark are reflected, at the determination position; determining, by the control device, a first threshold from a length between the reference mark and the first end portion in the transfer direction, based on the first reference image; controlling, by the control device, the first camera to capture a first comparison video so that the reference mark and the lower end portion of the substrate holder are reflected, when and after the transfer device stops; sequentially determining, by the control device, a first variation comparison value from a length between the reference mark and the lower end portion of the substrate holder in the transfer direction, based on the first comparison video; and comparing, by the control device, the first threshold and the first variation comparison value, to consider that the lower end portion of the substrate holder protrudes outside the region, when the first variation comparison value exceeds the first threshold.

When the first variation comparison value is equal to or less than the first threshold, the length from the reference mark to the lower end portion of the substrate holder in the transfer direction is equal to or less than the length from the reference mark to the first end portion in the transfer direction. Specifically, when the first variation comparison value is equal to or less than the first threshold, the lower end portion of the substrate holder definitely does not protrude outside the region from a side of the first end portion. On the other hand, when the first variation comparison value exceeds the first threshold, the length from the reference mark to the lower end portion of the substrate holder in the transfer direction may exceed the length from the reference mark to the first end portion in the transfer direction, and the lower end portion of the substrate holder may protrude outside the region from the side of the first end portion.

According to the plating apparatus of Supplement 4, when the first variation comparison value exceeds the first threshold, the lower end portion of the substrate holder is considered to protrude outside the region. Thereby, in this plating apparatus, when the lower end portion of the substrate holder protrudes outside the region where the opening of the processing tank is extended in the vertical direction, the lower end portion can be definitely determined to protrude. Then, in this plating apparatus, the test acceleration is determined to have the inappropriate value, when there is concern that the lower end portion protrudes outside the region.

(Supplement 5)

According to the plating apparatus of Supplement 5, in the plating apparatus according to Supplement 4, the control device sets, as the first threshold, the number of pixels from the reference mark to the first end portion in the transfer direction in the first reference image, and sets, as the first variation comparison value, the number of pixels from the reference mark to the lower end portion of the substrate holder in the transfer direction in each still image constituting the first comparison video.

(Supplement 6)

According to the plating apparatus of Supplement 6, in the plating apparatus according to Supplement 4 or 5, the imaging device includes a second camera that images the lower end portion of the substrate holder, the second end portion and the reference mark, the control device controls the second camera, and when the transfer device is located at the determination position, a center of the second camera is located directly above the opening, and the test includes controlling, by the control device, the second camera to capture a second reference image so that the second end portion and the reference mark are reflected, at the determination position; determining, by the control device, a second threshold from a length between the reference mark and the second end portion in the transfer direction, based on the second reference image; controlling, by the control device, the second camera to capture a second comparison video so that the reference mark and the lower end portion of the substrate holder are reflected, when and after the transfer device stops; sequentially determining, by the control device, a second variation comparison value from a length between the reference mark and the lower end portion of the substrate holder in the transfer direction, based on the second comparison video; and comparing, by the control device, the second threshold and the second variation comparison value, to consider that the lower end portion of the substrate holder protrudes outside the region, when the second variation comparison value exceeds the second threshold.

When the second variation comparison value is equal to or less than the second threshold, the length from the reference mark to the lower end portion of the substrate holder in the transfer direction is equal to or less than the length from the reference mark to the second end portion in the transfer direction. Specifically, when the second variation comparison value is equal to or less than the second threshold, the lower end portion of the substrate holder definitely does not protrude outside the region from a side of the second end portion. On the other hand, when the second variation comparison value exceeds the second threshold, the length from the reference mark to the lower end portion of the substrate holder in the transfer direction may exceed the length from the reference mark to the second end portion in the transfer direction, and the lower end portion of the substrate holder may protrude outside the region from the side of the first end portion.

According to the plating apparatus of Supplement 6, when the second variation comparison value exceeds the second threshold, the lower end portion of the substrate holder is considered to protrude outside the region. Thereby, in this plating apparatus, when the lower end portion of the substrate holder protrudes outside the region where the opening of the processing tank is extended in the vertical direction, the lower end portion can be definitely determined to protrude. Then, in this plating apparatus, the test acceleration is determined to have the inappropriate value, when there is concern that the lower end portion protrudes outside the region.

(Supplement 7)

According to the plating apparatus of Supplement 7, in the plating apparatus according to Supplement 6, the control device sets, as the second threshold, the number of pixels from the reference mark to the second end portion in the transfer direction in the second reference image, and sets, as the second variation comparison value, the number of pixels from the reference mark to the lower end portion of the substrate holder in the transfer direction in each still image constituting the second comparison video.

(Supplement 8)

According to the plating apparatus of Supplement 8, in the plating apparatus according to Supplement 6 or 7, the plating apparatus is settable to a second mode during a normal operation, and in the second mode, the control device moves the transfer device from a reference position to the determination position so that the transfer device gripping the substrate holder stops at the determination position, controls the first camera to capture a third comparison video so that the reference mark and the lower end portion of the substrate holder are reflected when and after the transfer device stops, controls the second camera to capture a fourth comparison video so that the reference mark and the lower end portion of the substrate holder are reflected, sequentially determines, based on the third comparison video, a third variation comparison value from a length between the reference mark and the lower end portion of the substrate holder in the transfer direction, sequentially determines, based on the fourth comparison video, a fourth variation comparison value from the length between the reference mark and the lower end portion of the substrate holder in the transfer direction, and stops the transfer device when the third variation comparison value exceeds the first threshold or when the fourth variation comparison value exceeds the second threshold.

When the third variation comparison value exceeds the first threshold, there is concern that the lower end portion of the substrate holder protrudes outside the region from the side of the first end portion. When the fourth variation comparison value exceeds the second threshold, there is concern that the lower end portion of the substrate holder protrudes outside the region from the side of the second end portion.

According to the plating apparatus of Supplement 8, when the third variation comparison value exceeds the first threshold or when the fourth variation comparison value exceeds the second threshold, the transfer device stops. Thereby, in this plating apparatus, the transfer device does not transfer the substrate holder in the vertical direction after transferring the substrate holder in the transfer direction. Specifically, this plating apparatus can prevent contact between the substrate holder and the processing tank during the normal operation.

(Supplement 9)

According to the plating apparatus of Supplement 9, in the plating apparatus according to any one of Supplements 1 to 8, the reference position includes positions directly above a load/unload station, a stocker, a prewet module, a presoak module, a first rinse module, a second rinse module, a blow module and a plating tank.

(Supplement 10)

According to the plating apparatus of Supplement 10, in the plating apparatus according to any one of Supplements 1 to 9, the determination position includes positions directly above a load/unload station, a stocker, a prewet module, a presoak module, a first rinse module, a second rinse module, a blow module and a plating tank.

(Supplement 11)

According to the plating apparatus of Supplement 11, in the plating apparatus according to any one of Supplements 1 to 10, in a third mode, the control device controls the imaging device to capture a first reference still image that is an image of the opening of the processing tank when the substrate holder is allowed to enter the processing tank through the opening, controls the imaging device to capture a first comparison still image that is an image of the opening of the processing tank from a position at which the first reference still image is captured before the transfer device transfers the substrate holder into the processing tank, and compares the first reference still image and the first comparison still image, to stop the transfer device when a match rate between the first reference still image and the first comparison still image is equal to or less than a predetermined value.

When the match rate between the first reference still image and the first comparison still image is low, a foreign object such as the lid may be placed over the opening of the processing tank. In this case, when the transfer device tries to store the substrate holder in the processing tank, the substrate holder comes in contact with the foreign object. As a result, the substrate holder might be damaged.

On the other hand, according to the plating apparatus of Supplement 11, when the match rate between the first reference still image and the first comparison still image is equal to or less than the predetermined value, the transfer device stops. Thereby, this plating apparatus can prevent the contact between the substrate holder and the foreign object.

(Supplement 12)

According to the plating apparatus of Supplement 12, in the plating apparatus according to any one of Supplements 1 to 11, in a fourth mode, the control device controls the imaging device to capture a second reference still image that is an image of a stocker when the substrate holder is housed in the stocker, controls the imaging device to capture a second comparison still image that is an image of the stocker from a position at which the second reference still image is captured, determines that the substrate holder is housed in the stocker when a match rate between the second reference still image and the second comparison still image is equal to or more than a predetermined value, determines that the substrate holder is not housed in the stocker when the match rate between the second reference still image and the second comparison still image is less than the predetermined value, and outputs or stores loading information of the substrate holder in the stocker.

In the plating apparatus according to Supplement 12, the loading information of the substrate holder in the stocker can be output or stored.

(Supplement 13)

A control method for a plating apparatus according to Supplement 13 is a control method for a plating apparatus including: a step of controlling an imaging device to capture a reference image so that an opening of a processing tank and a reference mark are reflected when a transfer device is located at a determination position directly above the processing tank; a step of moving the transfer device from a reference position to the determination position so that the transfer device gripping a substrate holder decelerates at a test acceleration and stops at the determination position; a step of controlling the imaging device to capture a comparison video so that the reference mark and a lower end portion of the substrate holder are reflected when and after the transfer device stops; and a step of determining, based on the reference image and the comparison video, whether the lower end portion of the substrate holder protrudes outside a region where the opening is extended in a vertical direction when and after the transfer device stops, to determine that the test acceleration has an inappropriate value when the lower end portion protrudes outside the region.

The control method for the plating apparatus according to Supplement 13 can have the same effect as the plating apparatus according to Supplement 1. Specifically, the control method for this plating apparatus can determine the acceleration at the time of the inappropriate deceleration that may cause contact between the substrate holder and the processing tank.

(Supplement 14)

A nonvolatile storage medium according to Supplement 14 is a nonvolatile storage medium storing a program for allowing a computer to execute a method of controlling a plating apparatus, the program being stored for allowing the computer to execute: controlling an imaging device to capture a reference image so that an opening of a processing tank and a reference mark are reflected when a transfer device is located at a determination position directly above the processing tank; moving the transfer device from a reference position to the determination position so that the transfer device gripping a substrate holder decelerates at a test acceleration and stops at the determination position; controlling the imaging device to capture a comparison video so that the reference mark and a lower end portion of the substrate holder are reflected when and after the transfer device stops; and determining, based on the reference image and the comparison video, whether the lower end portion of the substrate holder protrudes outside a region where the opening is extended in a vertical direction when and after the transfer device stops, to determine that the test acceleration has an inappropriate value when the lower end portion protrudes outside the region.

The nonvolatile storage medium in which the program is stored according to Supplement 14 can have the same effect as the plating apparatus according to Supplement 1. Specifically, by executing the program stored in this nonvolatile storage medium, the acceleration at the time of the inappropriate deceleration that may cause the contact between the substrate holder and the processing tank is determined.

REFERENCE SIGNS LIST

100: plating apparatus
120: control device
126: storage medium
200: substrate holder
202: lower end portion
300: transfer device
310: imaging device
312: first camera
314: second camera
400: processing tank
402: reference mark
410: opening
412: first end portion
414: second end portion
416: region

What is claimed is:

1. A plating apparatus comprising:

a transfer device for transferring a substrate holder in a vertical direction and a transfer direction perpendicular to the vertical direction, the transfer device including an imaging device, a processing tank having an opening for the substrate holder to be put inside, a reference mark, and a control device that controls the transfer device and the imaging device, the plating apparatus having a first mode in which the control device is configured to execute a test at a test acceleration, the test including:

controlling, by the control device, the imaging device to capture a reference image so that the opening and the reference mark are reflected, when the transfer device is located at a determination position directly above the processing tank;

moving, by the control device, the transfer device from a reference position to the determination position so that the transfer device gripping the substrate holder decelerates at the test acceleration and stops at the determination position;

controlling, by the control device, the imaging device to capture a comparison video so that the reference mark and a lower end portion of the substrate holder are reflected, when and after the transfer device stops; and determining, by the control device, whether the lower end portion of the substrate holder protrudes outside a region where the opening is extended in the vertical direction when and after the transfer device stops, based on the reference image and the comparison video, to determine that the test acceleration has an inappropriate value when the lower end portion protrudes outside the region, wherein the control device performs normal operation of the plating apparatus using the acceleration that is not determined to be the inappropriate value.

2. The plating apparatus according to claim 1, wherein the test acceleration is constant from start of deceleration to stop.

3. The plating apparatus according to claim 2, wherein the control device is configured to execute the test at a plurality of test accelerations, the control device repeatedly executes the test at the test accelerations in order from the test acceleration with the largest magnitude until the test acceleration that is not determined to have an inappropriate value is found, and the control device outputs or stores, as a maximum allowable acceleration, the test acceleration that is not determined to have the inappropriate value and that is first found as a result of the repetition.

4. The plating apparatus according to claim 1, wherein the opening has a first end portion extending on a first straight line orthogonal to the transfer direction and the vertical direction, and a second end portion extending on a second straight line parallel to the first straight line, the imaging device includes a first camera that images the lower end portion of the substrate holder, the first end portion and the reference mark, the control device controls the first camera, the reference mark is located between the first straight line and the second straight line in the transfer direction, when the transfer device is located at the determination position, a center of the first camera is located directly above the opening, and the test includes:

controlling, by the control device, the first camera to capture a first reference image so that the first end portion and the reference mark are reflected, at the determination position;

determining, by the control device, a first threshold from a length between the reference mark and the first end portion in the transfer direction, based on the first reference image;

controlling, by the control device, the first camera to capture a first comparison video so that the reference mark and the lower end portion of the substrate holder are reflected, when and after the transfer device stops;

sequentially determining, by the control device, a first variation comparison value from a length between the reference mark and the lower end portion of the substrate holder in the transfer direction, based on the first comparison video; and comparing, by the control device, the first threshold and the first variation comparison value, to consider that the lower end portion of the substrate holder protrudes outside the region, when the first variation comparison value exceeds the first threshold.

5. The plating apparatus according to claim 4, wherein the control device:

sets, as the first threshold, the number of pixels from the reference mark to the first end portion in the transfer direction in the first reference image, and sets, as the first variation comparison value, the number of pixels from the reference mark to the lower end portion of the substrate holder in the transfer direction in each still image constituting the first comparison video.

6. The plating apparatus according to claim 4, wherein the imaging device includes a second camera that images the lower end portion of the substrate holder, the second end portion and the reference mark, the control device controls the second camera, when the transfer device is located at the determination position, a center of the second camera is located directly above the opening, and the test includes:

controlling, by the control device, the second camera to capture a second reference image so that the second end portion and the reference mark are reflected, at the determination position;

determining, by the control device, a second threshold from a length between the reference mark and the second end portion in the transfer direction, based on the second reference image;

controlling, by the control device, the second camera to capture a second comparison video so that the reference mark and the lower end portion of the substrate holder are reflected, when and after the transfer device stops;

sequentially determining, by the control device, a second variation comparison value from a length between the reference mark and the lower end portion of the substrate holder in the transfer direction, based on the second comparison video; and comparing, by the control device, the second threshold and the second variation comparison value, to consider that the lower end portion of the substrate holder protrudes outside the region, when the second variation comparison value exceeds the second threshold.

7. The plating apparatus according to claim 6, wherein the control device:

sets, as the second threshold, the number of pixels from the reference mark to the second end portion in the transfer direction in the second reference image, and sets, as the second variation comparison value, the number of pixels from the reference mark to the lower end portion of the substrate holder in the transfer direction in each still image constituting the second comparison video.

8. The plating apparatus according to claim 6, which is settable to a second mode during a normal operation, wherein in the second mode, the control device:

moves the transfer device from a reference position to the determination position so that the transfer device gripping the substrate holder stops at the determination position, controls the first camera to capture a third comparison video so that the reference mark and the lower end portion of the substrate holder are reflected when and after the transfer device stops, and controls the second camera to capture a fourth comparison video so that the reference mark and the lower end portion of the substrate holder are reflected, sequentially determines, based on the third comparison video, a third variation comparison value from a length between the reference mark and the lower end portion of the substrate holder in the transfer direction, sequentially determines, based on the fourth comparison video, a fourth variation comparison value from the length between the reference mark and the lower end portion of the substrate holder in the transfer direction, and stops the transfer device when the third variation comparison value exceeds the first threshold or when the fourth variation comparison value exceeds the second threshold.

9. The plating apparatus according to claim 1, wherein the reference position includes positions directly above a load/unload station, a stocker, a prewet module, a presoak module, a first rinse module, a second rinse module, a blow module and a plating tank.

10. The plating apparatus according to claim 1, wherein the determination position includes positions directly above a load/unload station, a stocker, a prewet module, a presoak module, a first rinse module, a second rinse module, a blow module and a plating tank.

11. The plating apparatus according to claim 1, wherein in a third mode, the control device:

controls the imaging device to capture a first reference still image that is an image of the opening of the processing tank when the substrate holder is allowed to enter the processing tank through the opening, controls the imaging device to capture a first comparison still image that is an image of the opening of the processing tank from a position at which the first reference still image is captured before the transfer device transfers the substrate holder into the processing tank, and compares the first reference still image and the first comparison still image, to stop the transfer device when a match rate between the first reference still image and the first comparison still image is equal to or less than a predetermined value.

12. The plating apparatus according to claim 1, wherein in a fourth mode, the control device:

controls the imaging device to capture a second reference still image that is an image of a stocker when the substrate holder is housed in the stocker, controls the imaging device to capture a second comparison still image that is an image of the stocker from a position at which the second reference still image is captured, determines that the substrate holder is housed in the stocker when a match rate between the second reference still image and the second comparison still image is equal to or more than a predetermined value, determines that the substrate holder is not housed in the stocker when the match rate between the second reference still image and the second comparison still image is less than the predetermined value, and outputs or stores loading information of the substrate holder in the stocker.

* * * * *